US008348261B2

(12) United States Patent
Moriyama

(10) Patent No.: US 8,348,261 B2
(45) Date of Patent: Jan. 8, 2013

(54) PAPER INVERTING APPARATUS AND ELECTRONIC DEVICE PROVIDED WITH THE PAPER INVERTING APPARATUS

(75) Inventor: Ryuji Moriyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 123 days.

(21) Appl. No.: 12/788,514

(22) Filed: May 27, 2010

(65) Prior Publication Data

US 2010/0301549 A1 Dec. 2, 2010

(30) Foreign Application Priority Data

Jun. 1, 2009 (JP) ..... 2009-132564

(51) Int. Cl.
*B65H 29/00* (2006.01)
*B65H 39/10* (2006.01)
*G03G 15/00* (2006.01)

(52) U.S. Cl. ..... 271/186; 399/364; 271/303

(58) Field of Classification Search ..... 271/3.18, 271/186, 3.14, 184, 301, 302, 303, 291, 298; 399/364

See application file for complete search history.

(56) References Cited

U.S. PATENT DOCUMENTS

| | | | | |
|---|---|---|---|---|
| 5,690,325 | A * | 11/1997 | Morimoto | 271/65 |
| 5,953,575 | A * | 9/1999 | Park et al. | 399/401 |
| 6,547,241 | B2 * | 4/2003 | Yoshida et al. | 271/303 |
| 6,575,455 | B2 * | 6/2003 | Thøgersen et al. | 271/186 |
| 7,016,090 | B2 | 3/2006 | Sekine et al. | |
| 7,549,723 | B2 * | 6/2009 | Mihara et al. | 347/23 |
| 2002/0074722 | A1 * | 6/2002 | Dobrindt | 271/303 |
| 2008/0003032 | A1 | 1/2008 | Nonaka et al. | |
| 2008/0018040 | A1 * | 1/2008 | Tamura et al. | 271/3.14 |
| 2008/0191413 | A1 * | 8/2008 | Fujita et al. | 271/302 |

FOREIGN PATENT DOCUMENTS

| | | |
|---|---|---|
| JP | 2002-348052 | 12/2002 |
| JP | 2003-002491 | 1/2003 |
| JP | 2006-298605 | 11/2006 |
| JP | 2008-033236 | 2/2008 |

* cited by examiner

*Primary Examiner* — Patrick Cicchino
(74) *Attorney, Agent, or Firm* — Workman Nydegger

(57) ABSTRACT

A paper inverting apparatus that inverts the front and back of paper by transporting the paper through a paper inverting path that inverts the front and back of the paper, includes an extending/contracting mechanism that extends/contracts the path length of a circulation path of which the paper inverting path is configured.

8 Claims, 18 Drawing Sheets

DUAL-SIDED RECORDING SEQUENCE

PAPER INVERTING APPARATUS AND ELECTRONIC DEVICE PROVIDED WITH THE PAPER INVERTING APPARATUS

BACKGROUND

1. Technical Field

The present invention relates to a paper inverting apparatus that inverts the front and back of paper by transporting the paper through a paper inverting path that inverts the front and back of the paper.

2. Related Art

Electronic devices such as printers provided with a dual-side automatic print function, scanners, facsimiles, and the like provided with dual-side automatic reading functions, and so on are known. Such electronic devices are provided with paper inverting apparatuses for automatically inverting the front and back of recording paper, an original document, or the like. To be more specific, using a printer provided with a dual-side automatic print function as an example, after recording has been executed on the front surface of a piece of recording paper, the recording paper passes through a paper inverting path, thereby inverting the front and back of the recording paper; the recording paper is then once again transported to a recording execution unit, and recording is carried out on the back surface of the recording paper (for example, see JP-A-2006-298605).

An apparatus in which the paper temporarily protrudes from a discharge opening during the process of transporting the paper to the paper inverting path is known as an example of a general paper inverting apparatus. Such a paper inverting apparatus has an advantage in that it is comparatively easy to reduce the size of an electronic device that is provided with that paper inverting apparatus. However, with such a paper inverting apparatus, there is a disadvantage in that when the paper temporarily protrudes from the discharge opening, there is a risk that a user will mistake that paper as paper that has been discharged and touch that paper with his/her hand.

Meanwhile, an apparatus in which the paper does not protrude to the exterior of the apparatus at all during the process for transporting the paper to the paper inverting path is also known as an example of a general paper inverting apparatus. Such a paper inverting apparatus is advantageous in terms of safety because there is no risk that a user will touch the paper during the process for transporting the paper to the paper inverting path. However, such a paper inverting apparatus has a disadvantage in that it increases the size of the electronic device in which that paper inverting apparatus is provided.

Finally, an electronic device provided with a paper inverting apparatus that includes both a paper inverting path in which the paper temporarily protrudes from a discharge opening during the process for inverting the front and back of the paper and a paper inverting path in which the paper does not protrude, and is configured so as to switch between the paper inverting paths based on the length of the paper, is known (for example, see JP-A-2006-298605).

In recent years, there is an increased demand, in electronic devices such as printers, scanners, facsimiles, and the like, to further increase the speed at which recording is executed, documents are read, and so on. This applies to printers provided with a dual-side automatic print function, scanners, facsimiles, and the like provided with dual-side automatic reading functions, and so on as well. However, it is necessary to set the path length of a circulation path in the paper inverting path of the paper inverting apparatus in accordance with the length of the maximum size of the paper that the electronic device can handle. Accordingly, the length of the circulation path is greater than necessary with respect to paper of smaller sizes. In other words, paper of a size that is smaller than the maximum size of the paper that can be handled by the electronic device undergoes front to back inversion by passing through a circulation path whose path length is longer than necessary, and thus the front to back inversion requires more time than is necessary. As a result, past paper inverting apparatuses are problematic in that the throughput in electronic devices such as printers provided with a dual-side automatic print function, scanners, facsimiles, and so on provided with dual-side automatic reading functions, drops with respect to paper of a size that is smaller than the maximum size of the paper that the electronic device can handle.

SUMMARY

An advantage of some aspects of the invention is to provide a paper inverting apparatus capable of inverting the front and back of paper in a shorter amount of time.

A first aspect of the invention is a paper inverting apparatus that inverts the front and back of paper by transporting the paper through a paper inverting path that inverts the front and back of the paper, the paper inverting apparatus including an extending/contracting mechanism that extends/contracts the path length of a circulation path of which the paper inverting path is configured.

The paper inverting path is a path that inverts the front and back of the paper transported through that path. The circulation path is part of the paper inverting path, and is a portion that configures a circular-shaped path.

According to this aspect, the path length of the circulation path can be extended/contracted based on the length of the paper (the length in the transport direction) whose front and back are to be inverted via the paper inverting path. Through this, the risk that the inversion of the front and back of the paper will be carried out via a circulation path whose path length is longer than necessary can be reduced.

Therefore, according to the paper inverting apparatus according to the first aspect of the invention, an effect can be achieved whereby a paper inverting apparatus capable of inverting the front and back of paper in a shorter amount of time can be realized.

A second aspect of the invention is the paper inverting apparatus according to the aforementioned first aspect, in which the extending/contracting mechanism has a first guide member and a second guide member that configure the circulation path, the first guide member and the second guide member being supported so as to be capable of displacement; forms a continuous paper guide surface by part of the first guide member and part of the second guide member engaging with each other in an intersecting state; and causes the circulation path to extend/contract by changing the position at which the first guide member and the second guide member intersect, by displacing at least one of the first guide member and the second guide member.

According to this aspect, the path length of the circulation path can be extended/contracted by displacing the first guide member and the second guide member. Accordingly, the path length of the circulation path can be extended/contracted based on the length of the paper whose front and back are to be inverted via the paper inverting path by adjusting the displacement positions of the first guide member and the second guide member. Through this, the risk that the inversion of the front and back of the paper will be carried out via a circulation path whose path length is longer than necessary can be reduced.

A third aspect of the invention is the paper inverting apparatus according to the aforementioned second aspect, in which the first guide member and the second guide member configure a continuous paper guide surface by engaging with each other in a state in which a comb-tooth-shaped engagement portion provided in the first guide member and a comb-tooth-shaped engagement portion provided in the second guide member intersect with each other.

According to this aspect, a paper guide surface capable of extending/contracting the path length of the circulation path can be configured of the first guide member and the second guide member, and a paper guide surface having a high degree of continuity across the first guide member and the second guide member can be configured. Accordingly, the risk of paper jams occurring due to paper becoming caught on the portions at which the first guide member and the second guide member engage and so on can be reduced.

A fourth aspect of the invention is the paper inverting apparatus according to one of the aforementioned first to third aspects, further including a driving unit of the extending/contracting mechanism and a control unit that controls the driving unit. The control unit controls the driving unit based on the length of the paper in the direction in which the paper is transported in the circulation path.

According to this aspect, the path length of the circulation path can be automatically extended/contracted to the optimum path length based on the length of the paper whose front and back are to be inverted via the paper inverting path. Accordingly, the usability of the paper inverting apparatus can be improved. Furthermore, the risk of using more time than is necessary in the inversion of the front and back of the paper due to the path length of the circulation path being too long, and conversely, the risk of paper jams and the like occurring due to the path length of the circulation path being too short, can be reduced.

A fifth aspect of the invention is a paper inverting apparatus that inverts the front and back of paper by transporting the paper through a paper inverting path that inverts the front and back of the paper. The paper inverting path has multiple circulation paths having different path lengths, and the paper inverting apparatus includes a path selection mechanism for selecting one of the multiple circulation paths.

According to this aspect, the circulation path with the optimal path length can be selected from among the multiple circulation paths having different path lengths based on the length of the paper whose front and back is to be inverted via the paper inverting path. Through this, the risk that the inversion of the front and back of the paper will be carried out via a circulation path whose path length is longer than necessary can be reduced.

Therefore, according to the paper inverting apparatus according to the fifth aspect of the invention, an effect can be achieved whereby a paper inverting apparatus capable of inverting the front and back of paper in a shorter amount of time can be realized.

A sixth aspect of the invention is the paper inverting apparatus according to the aforementioned fifth aspect, further including a driving unit of the path selection mechanism and a control unit that controls the driving unit. The control unit controls the driving unit based on the length of the paper in the direction in which the paper is transported in the circulation path.

According to this aspect, the circulation path with the optimal path length can be automatically selected from among the multiple circulation paths having different path lengths based on the length of the paper whose front and back is to be inverted via the paper inverting path. Accordingly, the usability of the paper inverting apparatus can be improved. Furthermore, the risk of using more time than is necessary in the inversion of the front and back of the paper due to the path length of the circulation path being too long, and conversely, the risk of paper jams and the like occurring due to the path length of the circulation path being too short, can be reduced.

A seventh aspect of the invention is an electric device including: a unit that executes recording onto a recording surface of paper or a unit that reads text or images recorded on recording paper; and the paper inverting apparatus according to one of the aforementioned first to sixth aspects.

According to the electronic device according to the seventh aspect of the invention, an effect can be achieved in an electronic device such as a printer provided with a dual-side automatic print function, a scanner, facsimile, or the like provided with a dual-side automatic reading function, whereby the throughput of the electronic device can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings.

General Configuration of Inkjet Printer

First, the general configuration of an ink jet printer 50, serving as an "electronic device" according to the invention, will be described with reference to FIG. 1.

Figure 1:
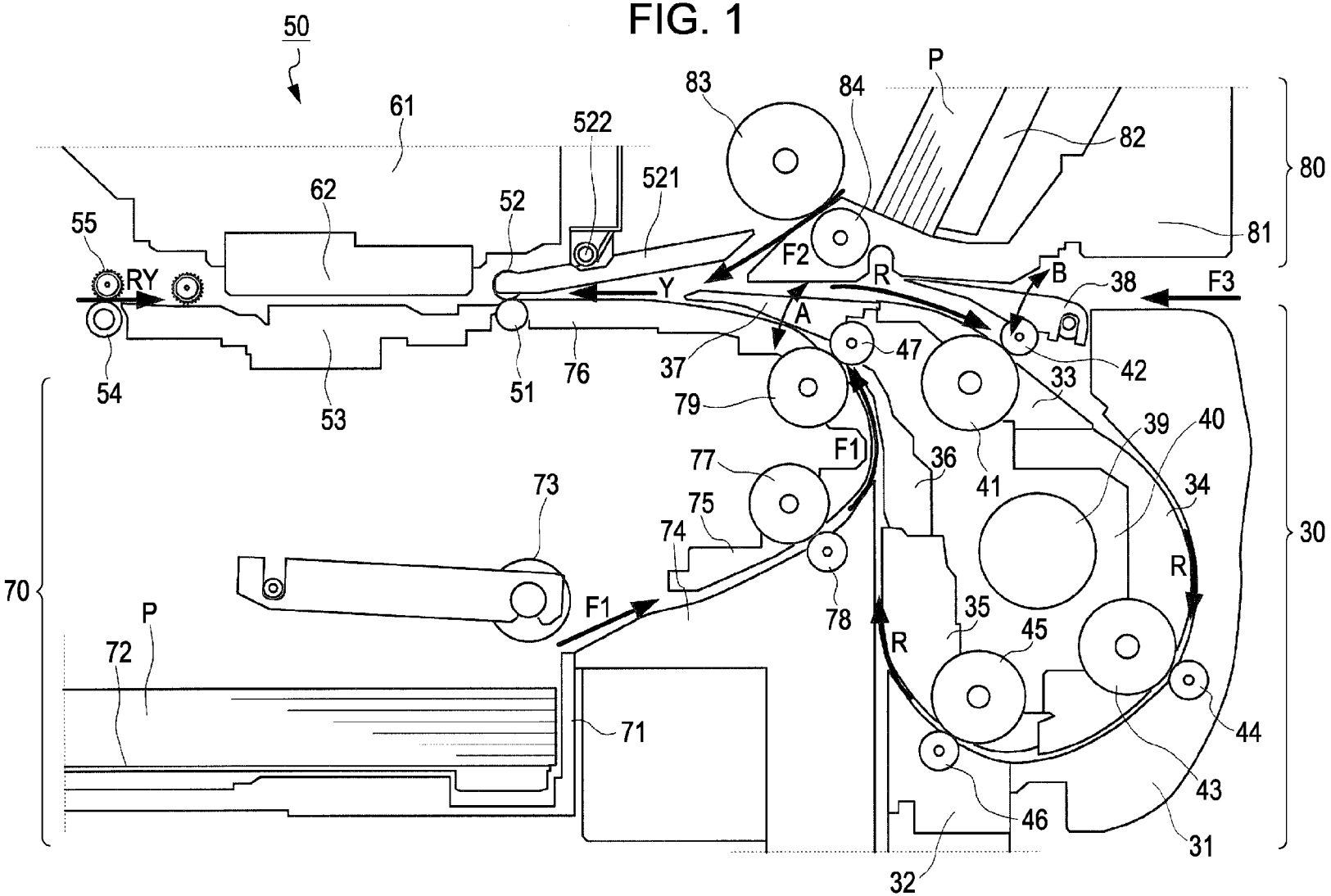
FIG. 1 is a side view illustrating principal portions of an ink jet printer.

FIG. 1 is a side view illustrating principal portions of the ink jet printer 50.

The ink jet printer 50 includes a first automatic supply unit 70 and a second automatic supply unit 80 that supply recording paper (not shown) to the interior of the ink jet printer 50.

The first automatic supply unit 70 includes a first supply tray 71, a first hopper 72, a first supply roller 73, guide members 74 to 76, intermediate driving rollers 77 and 79, and an intermediate slave roller 78.

The first supply tray 71 holds recording paper P, serving as "paper", in a stacked state. The first hopper 72 is provided at the base of the first supply tray 71, displaceable toward the first supply roller 73. The first supply roller 73 and intermediate driving rollers 77 and 79 rotate as a result of rotational driving force being transmitted thereto from a supply motor (not shown). The guide members 74 to 76 configure a first supply path F1, as shown in FIG. 1. The intermediate slave roller 78 is supported so as to be capable of slave rotation, and biases the recording paper P that is to be supplied along the first supply path F1 toward the outer circumferential surface of the intermediate driving roller 77.

The recording paper P that is uppermost in the recording paper P stacked in the first supply tray 71 makes contact with the outer circumferential surface of the first supply roller 73 as a result of the displacement of the first hopper 72, and is transported to the first supply path F1 as a result of the rotation of the first supply roller 73. Then, the recording paper P that has been delivered to the first supply path F1 is supplied, as a result of the rotation of the first supply roller 73 and intermediate driving rollers 77 and 79, to a position whereby the leading edge of the recording paper P reaches a contact portion between a transport driving roller 51 and a transport slave roller 52 (mentioned later).

The second automatic supply unit 80 includes a second supply tray 81, a second hopper 82, a second supply roller 83, and a retard roller 84.

The second supply tray 81 holds multiple pieces of recording paper P in a stacked state. The second hopper 82 is provided at the base of the second supply tray 81, displaceable toward the second supply roller 83. The second supply roller 83 rotates as a result of rotational driving force being transmitted thereto from a supply motor (not shown). The retard roller 84 is a known separating unit for preventing multi-feeding of the recording paper P, and is supported so as to be capable of slave rotation in a state in which a constant rotational resistance is applied thereto.

The recording paper P that is uppermost in the recording paper P stacked in the second supply tray 81 makes contact with the outer circumferential surface of the second supply roller 83 as a result of the displacement of the second hopper 82, and is transported to a second supply path F2 as a result of the rotation of the second supply roller 83. Then, the recording paper P that has been delivered to the second supply path F2 is supplied, as a result of the rotation of the second supply roller 83, to a position whereby the leading edge of the recording paper P reaches a contact portion between the transport driving roller 51 and the transport slave roller 52 (mentioned later).

The ink jet printer 50 includes a unit for executing recording onto a recording surface of the recording paper P supplied via the first supply path F1, the second supply path F2, or a manual supply path F3 (mentioned later). This unit that executes recording onto a recording surface of the recording paper P includes the transport driving roller 51, the transport slave roller 52, a platen 53, a discharge driving roller 54, a discharge slave roller 55, a carriage 61, and a recording head 62.

The transport driving roller 51 has a high-friction coating on the outer circumferential surface thereof, and rotates as a result of rotational driving force being transmitted thereto by a transport motor (not shown). The transport slave roller 52 is axially supported, so as to be capable of slave rotation, at the end of a slave roller holder 521 that is axially supported so as to be capable of swinging. The slave roller holder 521 is biased, by the spring force of a torsion coil spring 522, in a direction in which the transport slave roller 52 makes contact with the transport driving roller 51. The platen 53 supports the recording paper P that is transported in a sub scanning direction Y from the back surface of the recording paper P. A constant space is maintained between the head surface of the recording head 62 and the recording surface of the recording paper P by this platen 53. The discharge driving roller 54 rotates as a result of rotational driving force being transmitted thereto by a transport motor (not shown). The discharge slave roller 55 is axially supported so as to be capable of slave rotation, and is biased in the direction in which the discharge slave roller 55 makes contact with the discharge driving roller 54.

The carriage 61 is supported so as to be capable of back-and-forth movement in the main scanning direction. The main scanning direction is a direction that is orthogonal to the sub scanning direction Y along the recording surface of the recording paper P when the recording paper P is in a state supported by the platen 53. The carriage 61 is connected to an endless belt that is stretched across a driving pulley and a slave pulley of a carriage driving motor (not shown). The carriage 61 moves back and forth in the main scanning direction by the carriage driving motor being caused to rotate in both directions. The recording head 62 is installed in the carriage 61 so that the head surface thereof opposes the recording surface of the recording paper P when the recording paper P is in a state supported by the platen 53. Multiple ejection nozzles (not shown) for ejecting ink and forming dots upon the recording surface of the recording paper P are provided in the head surface of the recording head 62.

The ink jet printer 50 includes a paper inverting apparatus 30 for inverting the front and back of the recording paper P after recording has been executed on the front surface of the recording paper P.

Although in this embodiment, the paper inverting apparatus 30 is an optional apparatus that can be easily removed or attached by a user, it should be noted that the paper inverting apparatus 30 may be provided as an integral part of the ink jet printer 50.

The paper inverting apparatus 30 includes outer guide members 31 and 32, inner guide members 33 to 36, a first flap 37, and a second flap 38. These configure a first circulation path R of a "paper inverting path". Meanwhile, part of the first circulation path R is shared with the first supply path F1, as shown in FIG. 1.

The first flap 37 is supported so as to be freely swingable in a swinging direction indicated by the reference symbol A, and makes contact with the guide member 76 under its own weight. When the recording paper P, onto the front surface of which recording has been executed, is transported in a reverse direction RY from the platen 53, the recording paper P is guided to the first circulation path R by the first flap 37. On the other hand, when the recording paper P is supplied via the first supply path F1, the recording paper P is supplied while pushing the first flap 37 upward. The second flap 38 is supported so as to be swingable in a swinging direction indicated by the reference symbol B, and can be caused to swing by an electromagnetic switch or the like (not shown). In a state in which the second flap 38 has been swung in the direction that blocks the first circulation path R, the device is in a state in which recording paper P can be manually supplied via the manual supply path F3. On the other hand, in a state in which the second flap 38 has been swung in the direction that blocks the manual supply path F3, the device is in a state in which the front and back of the recording paper P can be inverted by passing through the first circulation path R.

Meanwhile, the paper inverting apparatus 30 includes, as a "paper transport mechanism", a first inverting driving roller 41, a first inverting slave roller 42, a second inverting driving roller 43, a second inverting slave roller 44, a third inverting driving roller 45, a third inverting slave roller 46, and an intermediate slave roller 47, and also includes, as a "driving power source", a paper inverting motor 39.

The first inverting driving roller 41, second inverting driving roller 43, and third inverting driving roller 45 rotate as a result of rotational driving force being transmitted thereto from the paper inverting motor 39. The first inverting slave roller 42, second inverting slave roller 44, third inverting slave roller 46, and intermediate slave roller 47 are each supported so as to be capable of slave rotation. The first inverting slave roller 42 causes the recording paper P present in the first circulation path R to make contact with the outer circumferential surface of the first inverting driving roller 41. The second inverting slave roller 44 causes the recording paper P present in the first circulation path R to make contact with the outer circumferential surface of the second inverting driving roller 43. The third inverting slave roller 46 causes the recording paper P present in the first circulation path R to make contact with the outer circumferential surface of the third inverting driving roller 45. The intermediate slave roller 47 biases the recording paper P against the outer circumferential surface of the intermediate driving roller 79 in the area that is shared between the first supply path F1 and the first circulation path R.

The paper inverting motor 39 is, as shown in FIG. 1, disposed within an internal space formed within the first circulation path R by the members of which the first circulation path R is configured, or in other words, within an internal space 40 formed within the first circulation path R by the inner guide members 33 to 36.

In the ink jet printer 50 configured as described thus far, recording onto the recording paper P is executed through a control procedure such as that described hereinafter. The series of recording controls described hereinafter are executed by a control unit (not shown) including a known microprocessor control circuit, provided in the ink jet printer 50.

First, the recording paper P that has been supplied via the first supply path F1, the second supply path F2, or the manual supply path F3 is gripped by the transport driving roller 51 and the transport slave roller 52, and is transported along the platen 53 in the sub scanning direction Y as a result of the driving rotation of the transport driving roller 51. Recording onto the front surface of the recording paper P on the platen 53 is executed by alternately repeating an operation for forming dots by ejecting ink onto the recording surface from the head surface of the recording head 62 while the carriage 61 moves back and forth in the main scanning direction, and an operation for transporting the recording paper P a predetermined transport amount in the sub scanning direction Y as a result of the driving rotation of the transport driving roller 51. After recording has been executed on the front surface of the recording paper P, the recording paper P is gripped by the discharge driving roller 54 and the discharge slave roller 55, and is discharged by being transported in the sub scanning direction Y by the driving rotation of the discharge driving roller 54.

In the case where recording is also to be executed on the rear surface of the recording paper P, after the recording onto the front surface of the recording paper P has ended, the rotation of the transport driving roller 51 and the discharge driving roller 54 is inverted prior to the recording paper P being completely discharged. Through this, after recording has been executed onto the front surface of the recording paper P, the recording paper P is transported in the reverse direction RY, is guided by the first flap 37, and is delivered to the first circulation path R of the paper inverting apparatus 30. The recording paper P that has been delivered to the first circulation path R has its front and back inverted by passing through the first circulation path R. The recording paper P whose front and back have been inverted is then transported to a position where the leading edge of the recording paper P reaches the point of contact between the transport driving roller 51 and the transport slave roller 52. Then, the recording paper P whose front and back have been inverted is once again gripped by the transport driving roller 51 and the transport slave roller 52, and is transported along the platen 53 in the sub scanning direction Y by the driving rotation of the transport driving roller 51; recording is then executed on the back surface of the recording paper P, and the recording paper P is then discharged.

Note that the "paper inverting path" in the ink jet printer 50 according to this embodiment is a series of paths through which the recording paper P, for which the recording onto the front surface thereof has been completed, is transported in the reverse direction RY, and is then transported to a position where the leading edge of the recording paper P reaches the point of contact between the transport driving roller 51 and the transport slave roller 52 via the first circulation path R or a second circulation path SR (mentioned later).

First Embodiment of Paper Inverting Apparatus 30

A first embodiment of the paper inverting apparatus 30 will be described with reference to FIGS. 2 to 11.

Figure 2:
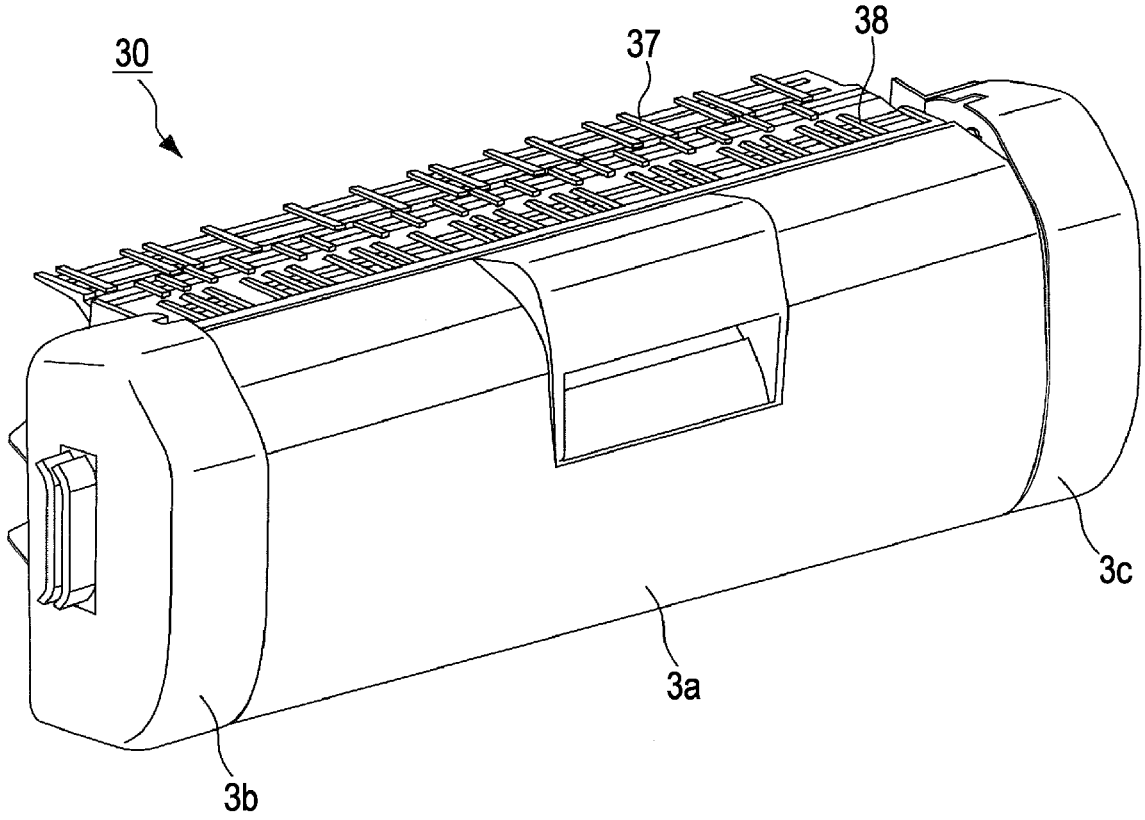
FIG. 2 is a perspective view illustrating the exterior of a paper inverting apparatus according to a first embodiment.

FIG. 2 is a perspective view illustrating the exterior of the paper inverting apparatus 30 according to the first embodiment.

The outer facing of the paper inverting apparatus 30 is configured of a front cover 3*a*, a left side cover 3*b*, and a right side cover 3*c*. The front cover 3*a* is provided so as to be openable/closable by a user.

Figure 3:
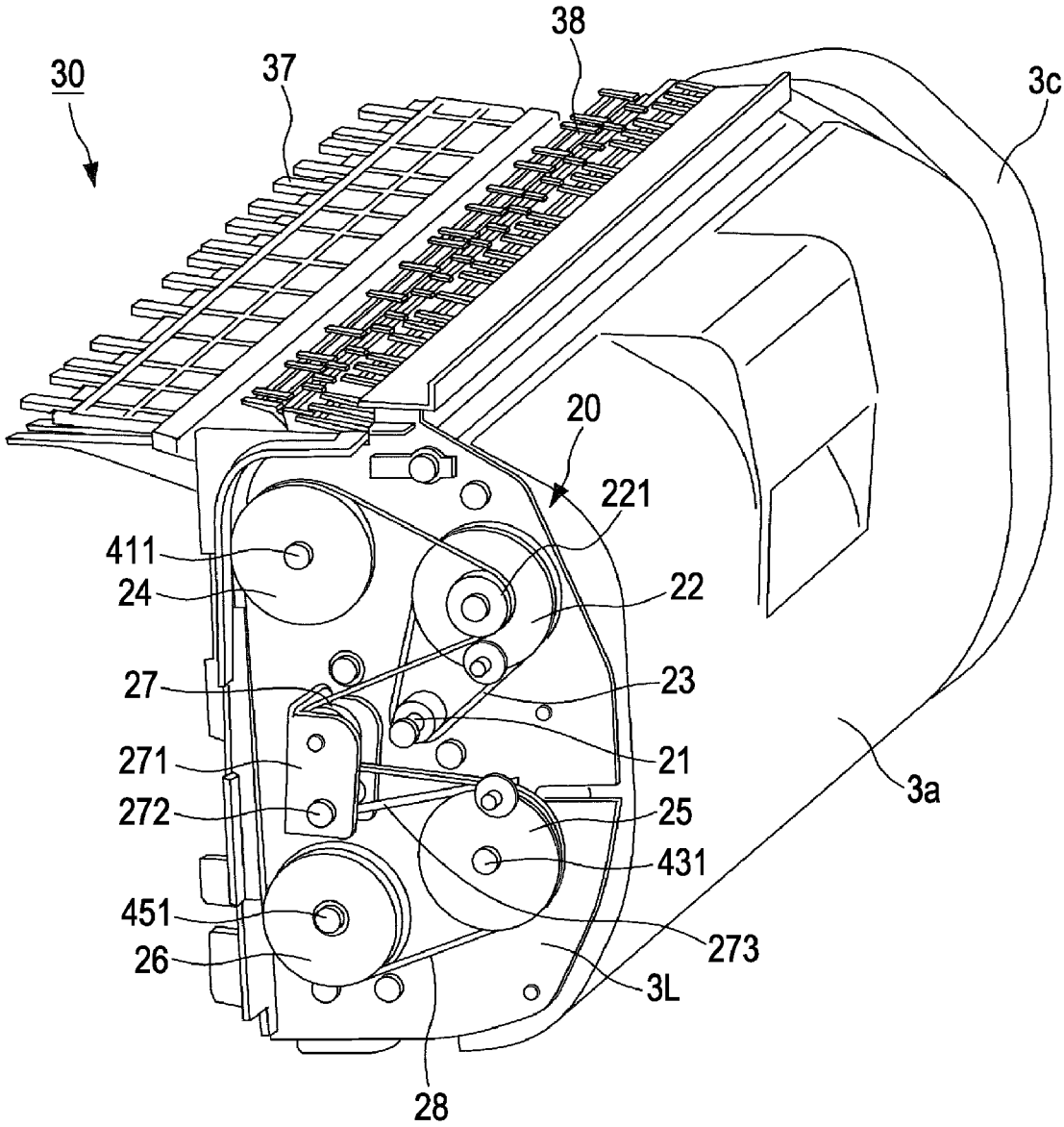
FIG. 3 is a perspective view illustrating principal portions of a paper inverting apparatus in a state in which a left side cover has been removed.

FIG. 3 is a perspective view illustrating principal portions of the paper inverting apparatus 30 according to the first embodiment, and illustrates a state in which the left side cover 3*b* has been removed.

A rotation transmission mechanism 20 for transmitting the rotational driving force from the paper inverting motor 39 to the first inverting driving roller 41, the second inverting driving roller 43, and the third inverting driving roller 45 is disposed on the inside of the left side cover 3*b*. The rotation transmission mechanism 20 includes a driving pulley 21, an intermediate gear 22, a first rotation transmission belt 23, a first gear 24, a second gear 25, a third gear 26, a tension roller 27, and a second rotation transmission belt 28.

The paper inverting motor 39 disposed in the internal space 40 of the paper inverting apparatus 30 has a rotational shaft, part of which protrudes into the inside area of the left side cover 3*b* via a through-hole provided in a left side frame 3L. The driving pulley 21 is attached in an integral manner to the rotational shaft of the paper inverting motor 39. The intermediate gear 22 is axially supported on the left side frame 3L. The first rotation transmission belt 23 is an endless belt, and is stretched upon the driving pulley 21 and the intermediate gear 22. In other words, when the paper inverting motor 39 rotates, the rotation of the driving pulley 21 is transmitted via the first rotation transmission belt 23, and the intermediate gear 22 rotates as a result.

The first gear 24 is attached in an integral manner to a first rotation shaft 411. The first rotation shaft 411 is a rotational shaft of the first inverting driving roller 41, and multiple first inverting driving rollers 41 are attached in an integral manner thereto. The second gear 25 is attached in an integral manner to a second rotation shaft 431. The second rotation shaft 431 is a rotational shaft of the second inverting driving roller 43, and multiple second inverting driving rollers 43 are attached in an integral manner thereto. The third gear 26 is attached in an integral manner to a third rotation shaft 451. The third rotation shaft 451 is a rotational shaft of the third inverting driving roller 45, and multiple third inverting driving rollers 45 are attached in an integral manner thereto. The first rotational shaft 411, the second rotational shaft 431, and the third rotational shaft 451 are axially supported by the left side frame 3L and a right side frame 3R (FIG. 4), of which the housing of the paper inverting apparatus 30 is configured.

The second rotation transmission belt 28 is an endless belt, and is stretched upon a small gear portion 221 of the intermediate gear 22, the first gear 24, the second gear 25, the third gear 26, and the tension roller 27. In other words, when the paper inverting motor 39 rotates, the rotation of the intermediate gear 22 is transmitted via the second rotation transmission belt 28, and then the first gear 24, the second gear 25, the third gear 26, and the tension roller 27 rotate as a result. Accordingly, the first inverting driving roller 41, the second inverting driving roller 43, and the third inverting driving roller 45 rotate. The tension roller 27 is a roller for providing a constant belt tension to the second rotation transmission belt 28, and is supported in a rotatable state by a tension roller holder 271. The tension roller holder 271 is supported by the left side frame 3L so as to be swingable about a swinging shaft portion 272. A torsion coil spring 273 biases the tension roller holder 271 in the swinging direction in which the belt tension has been provided to the second rotation transmission belt 28.

Figure 4:
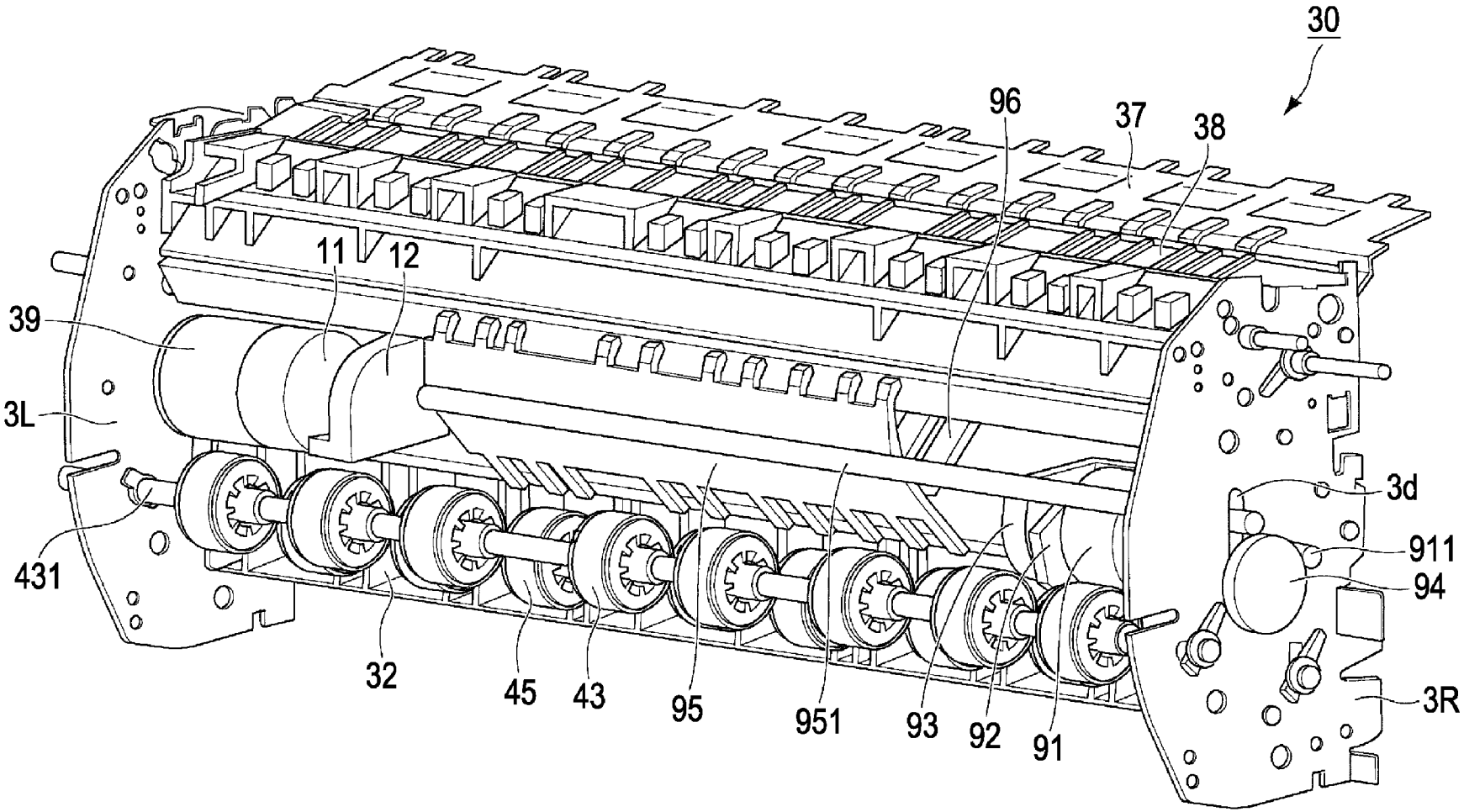
FIG. 4 is a perspective view illustrating principal portions of a paper inverting apparatus in a state in which an inside guide member has been removed.
Figure 5:
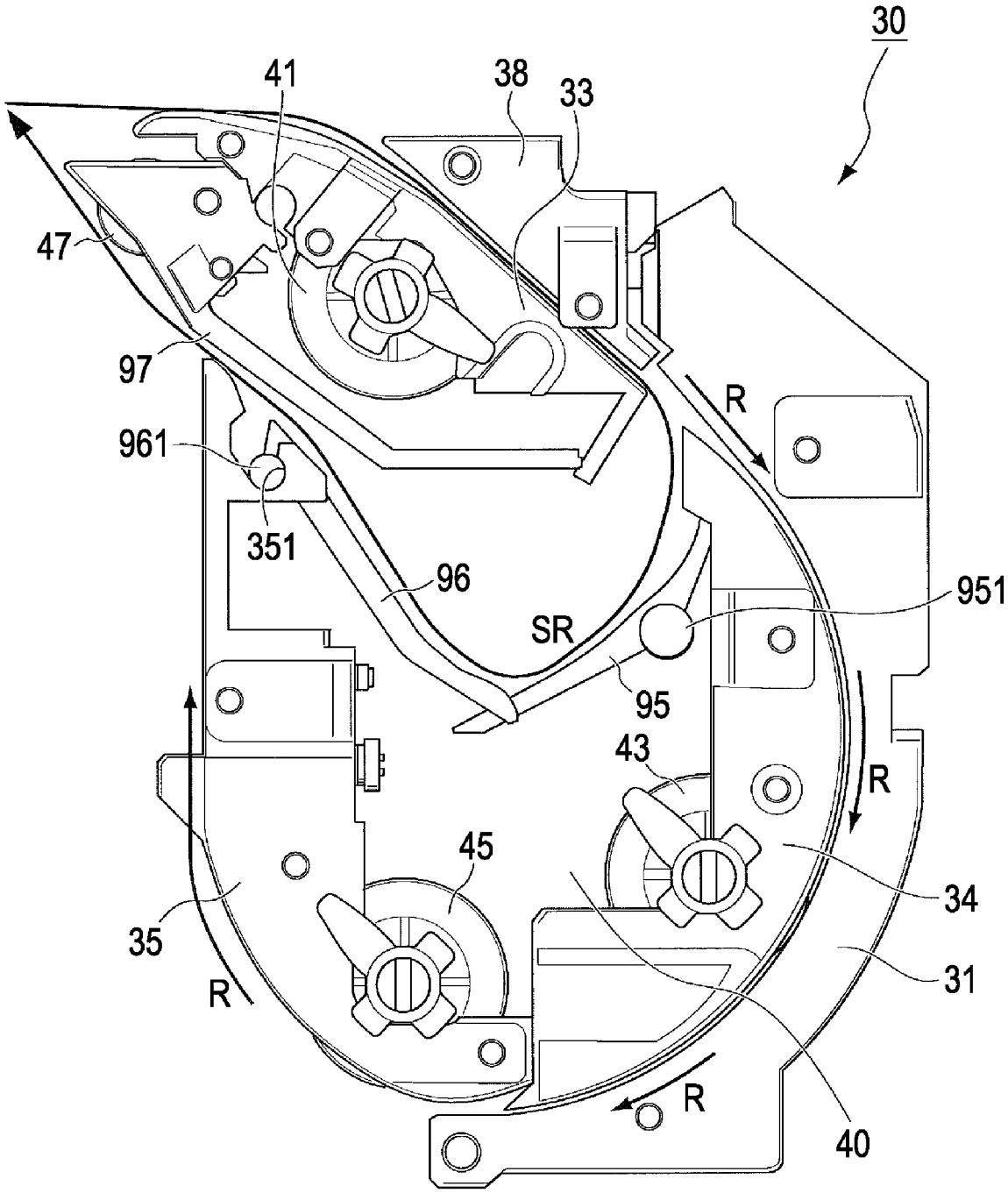
FIG. 5 is a cross-sectional side view of principal portions of a paper inverting apparatus according to the first embodiment.
Figure 6:
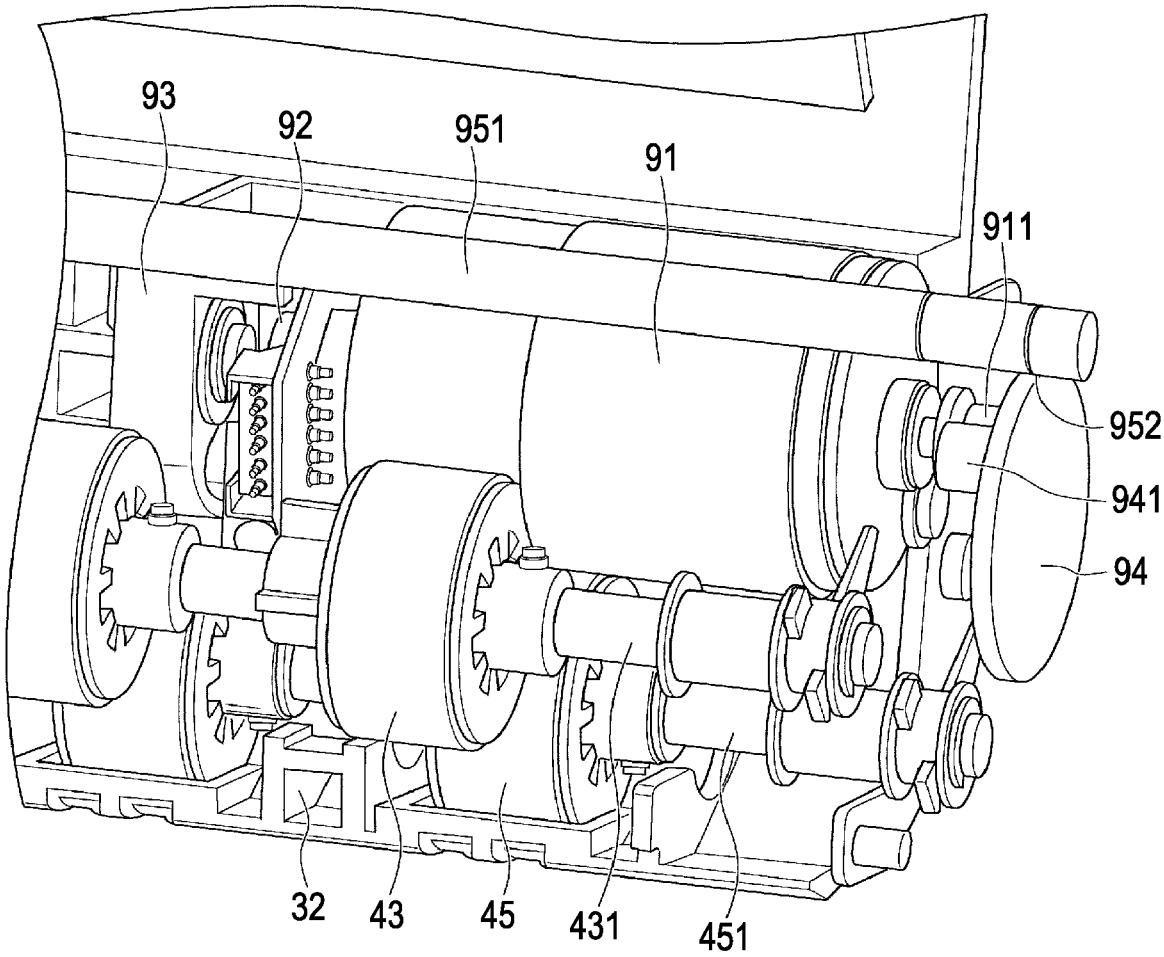
FIG. 6 is a perspective view illustrating principal portions in an enlarged view of a part of a paper inverting apparatus according to the first embodiment.

FIG. 4 is a perspective view illustrating principal portions of the paper inverting apparatus 30 according to the first embodiment, in a state in which the front cover 3*a* has been removed, the outer guide member 31 has been removed, and furthermore, the inner guide member 34 has been removed. FIG. 5, meanwhile, is a cross-sectional side view of principal portions of the paper inverting apparatus 30 according to the first embodiment. Finally, FIG. 6 is a perspective view illustrating principal portions in an enlarged view of a part of the paper inverting apparatus 30 according to the first embodiment.

A rotary encoder 11 and an encoder cover 12 are attached to the paper inverting motor 39.

The rotary encoder 11, which is a known rotary encoder, is a device for specifying a rotational amount and rotation direction of the paper inverting motor 39. The paper inverting motor 39 and the rotary encoder 11 are connected to the control unit and a power source unit (not shown), provided in the main body of the ink jet printer 50, via a cable (not shown). The supply of power and the input of control signals to the paper inverting motor 39 as well as the output of signals to the control unit from the rotary encoder 11 is carried out via this cable. The encoder cover 12 is provided so as to essentially cover and hide the rotary encoder 11. The encoder cover 12 is a member that, in the case where paper particles, ink mist, and the like adhering to the recording paper P have entered into the internal space 40, prevents those paper particles, ink mist, and so on from adhering to the rotary encoder 11.

The paper inverting apparatus 30 according to the invention includes a path switching and extending/contracting motor 91, a rotary encoder 92, an encoder cover 93, an eccentric rotational member 94, a first guide member 95, a second guide member 96, and a guidance member 97.

The first guide member 95, second guide member 96, and guidance member 97 configure a second circulation path SR that has a shorter path length than the first circulation path R. Meanwhile, the first guide member 95 and second guide member 96 configure an "extending/contracting mechanism" that causes the path length of the second circulation path SR to extend/contract. The path switching and extending/contracting motor 91, rotary encoder 92, and eccentric rotational member 94 configure an "extending/contracting mechanism driving unit". The rotary encoder 92 is a device for specifying a rotational amount and rotation direction of the path switching and extending/contracting motor 91, and has the same structure as the aforementioned rotary encoder 11. The encoder cover 93 is a member that, in the case where paper particles, ink mist, and the like adhering to the recording paper P have entered into the internal space 40, prevents those paper particles, ink mist, and so on from adhering to the rotary encoder 92.

The first guide member 95 has a shaft portion 951 that passes through a long hole 3*d* in the right side frame 3R, and is supported by the eccentric rotational member 94 in a state in which a contacted portion 952 of the shaft portion 951 slides along the outer circumferential surface of the eccentric rotational member 94. The eccentric rotational member 94 is axially supported by the right side frame 3R so as to be rotatable about an eccentric shaft portion 941. The eccentric shaft portion 941 of the eccentric rotational member 94 is interlocked with a driving pulley 911 of the path switching and extending/contracting motor 91. In other words, causing the path switching and extending/contracting motor 91 to rotate also rotates the eccentric rotational member 94 about the eccentric shaft portion 941, and as a result, the first guide member 95 displaces in the upward/downward direction along the long hole 3*d* of the right side frame 3R. The second guide member 96 is supported in a displaceable state by the inner guide member 35, in a state in which a support portion 351 provided in the inner guide member 35 is engaged with a shaft portion 961.

Figure 7:
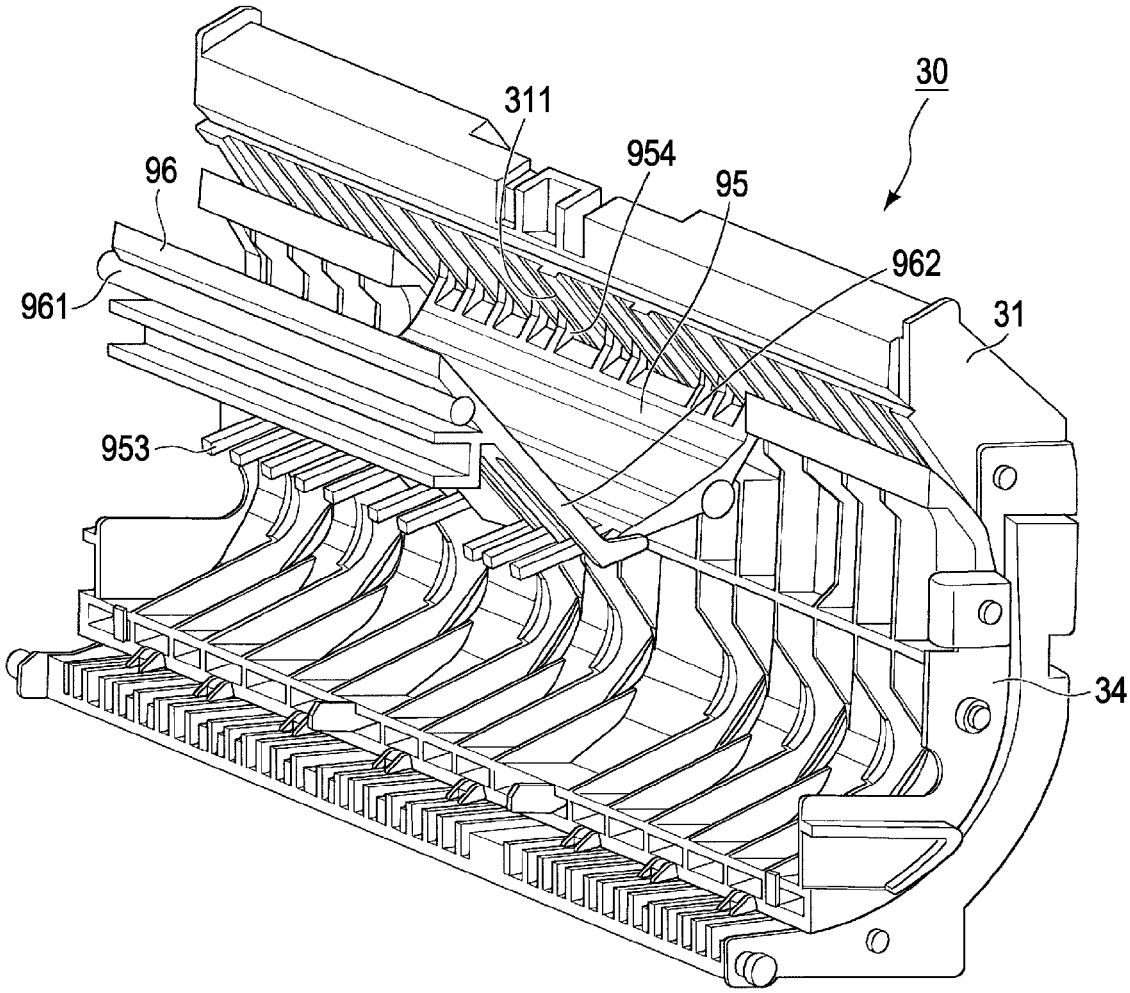
FIG. 7 is a perspective view illustrating principal portions in the vicinity of a section in which a first guide member and a second guide member are disposed.
Figure 8:
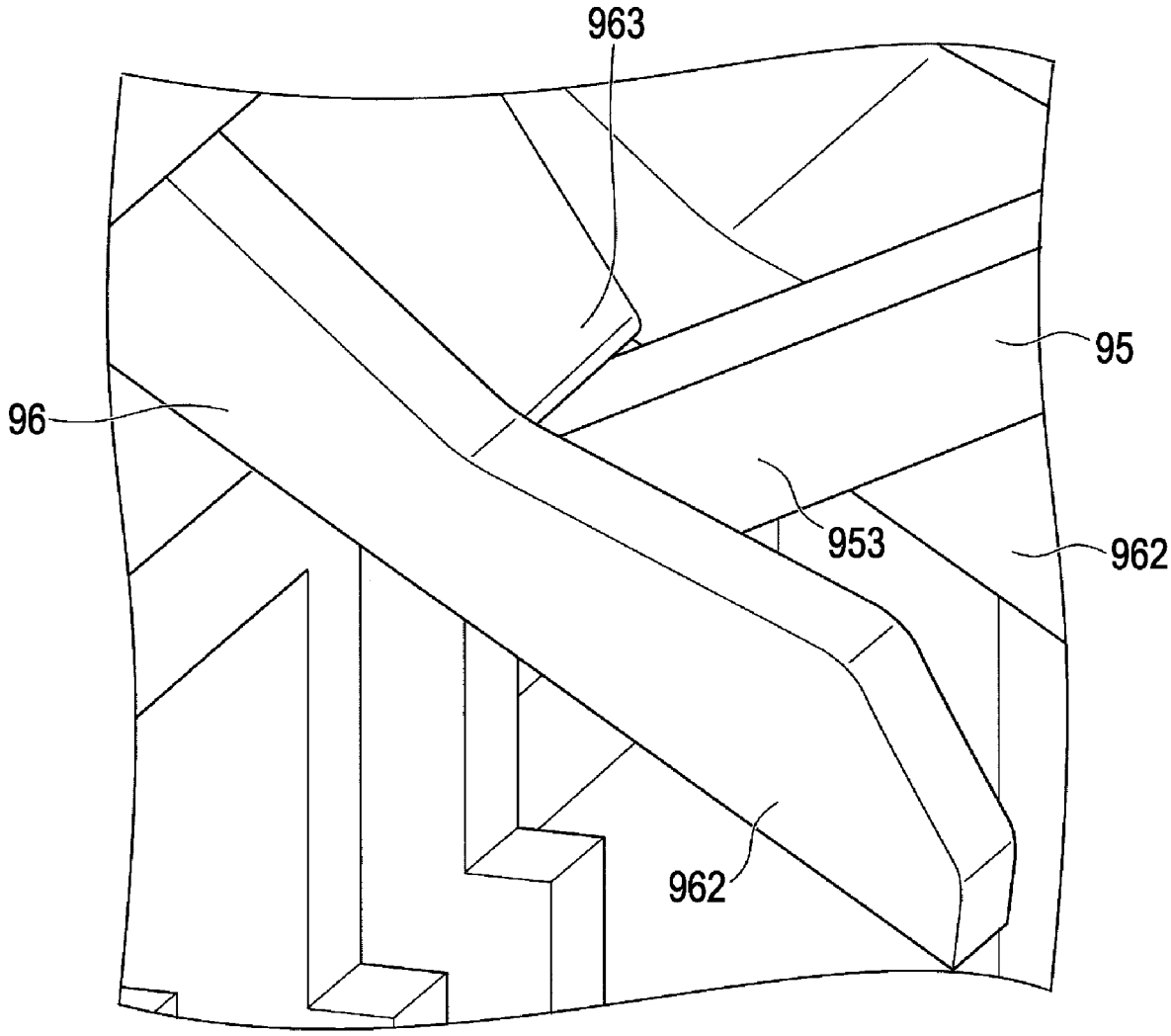
FIG. 8 is a cross-sectional side view of principal portions in a section where the first guide member and the second guide member engage.

FIG. 7 is a perspective view illustrating principal portions of the paper inverting apparatus 30 according to the first embodiment, and is an enlarged view illustrating the vicinity of the area where the first guide member 95 and second guide member 96 are disposed. FIG. 8, meanwhile, is a perspective view illustrating an enlarged view of an area in which the first guide member 95 and second guide member 96 engage.

The first guide member 95 and second guide member 96 engage in a state in which a comb-tooth-shaped engagement portion of the first guide member 95 (called a "comb-tooth portion" hereinafter) intersects with a comb-tooth portion 962 of the second guide member 96, thereby configuring a continuous paper guide surface. The vicinity of a leading end of the comb-tooth portion 953 of the first guide member 95 that has entered into the comb-tooth portion 962 of the second guide member 96 enters below a base member end portion 963 of the second guide member 96 (FIG. 8). Meanwhile, guide portions 954 of the first guide member 95 are provided in positions corresponding to areas between ribs 311 provided in the outer guide member 31.

Figure 9:
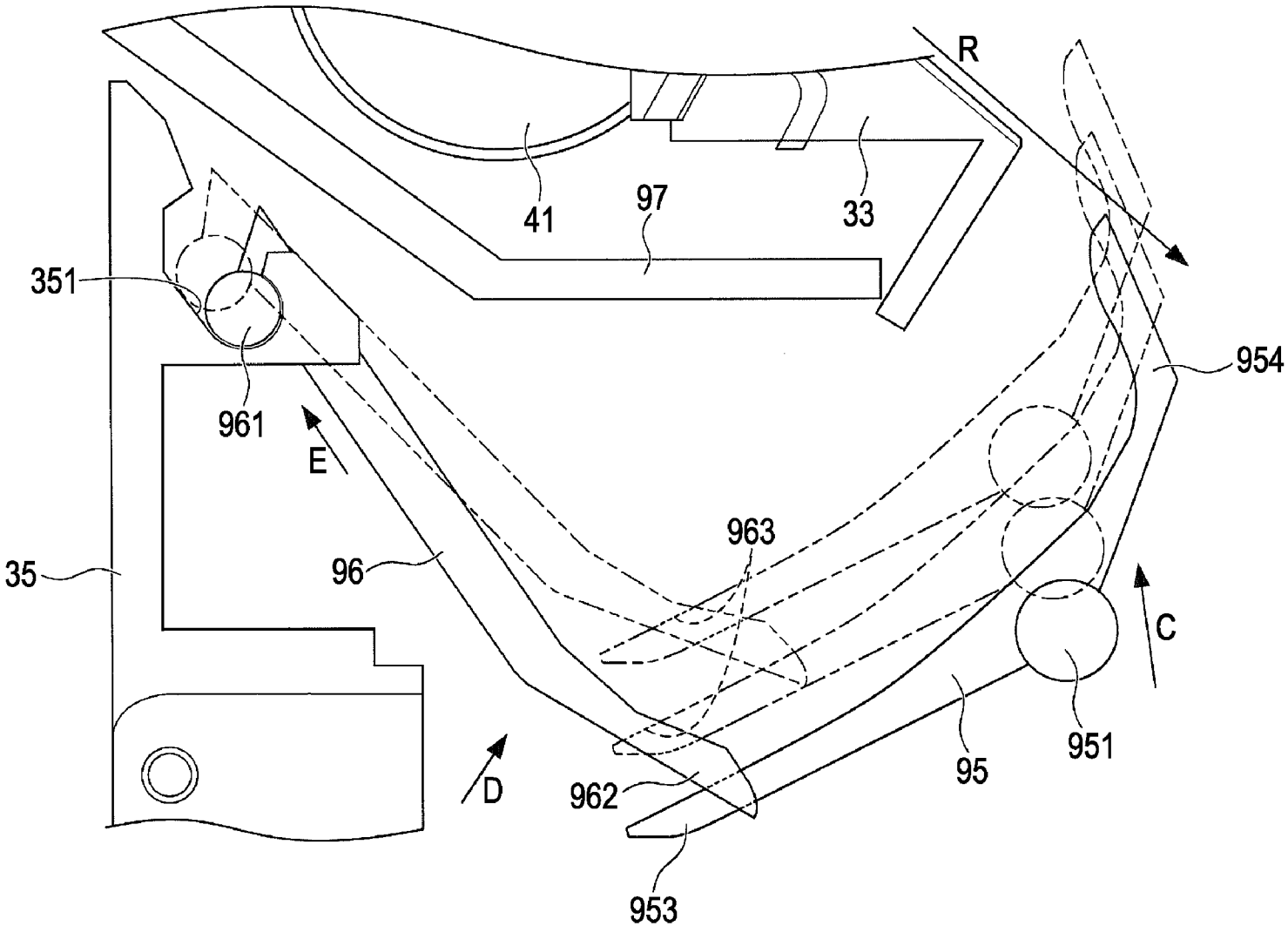
FIG. 9 is an enlarged perspective view illustrating a section in which the first guide member and the second guide member are disposed.
Figure 10:
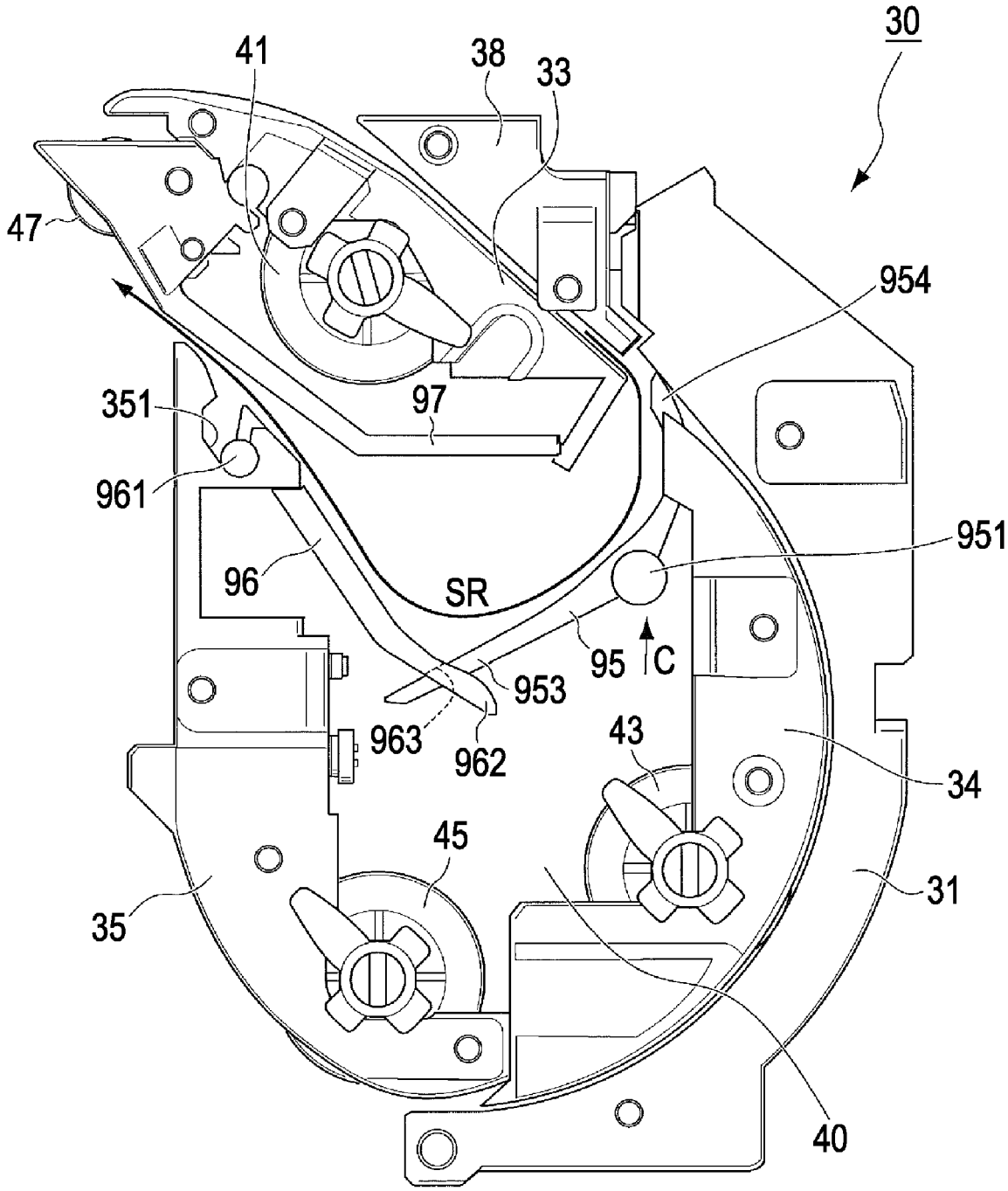
FIG. 10 is a cross-sectional side view illustrating principal portions in a state in which the path length of a second circulation path changes.
Figure 11:
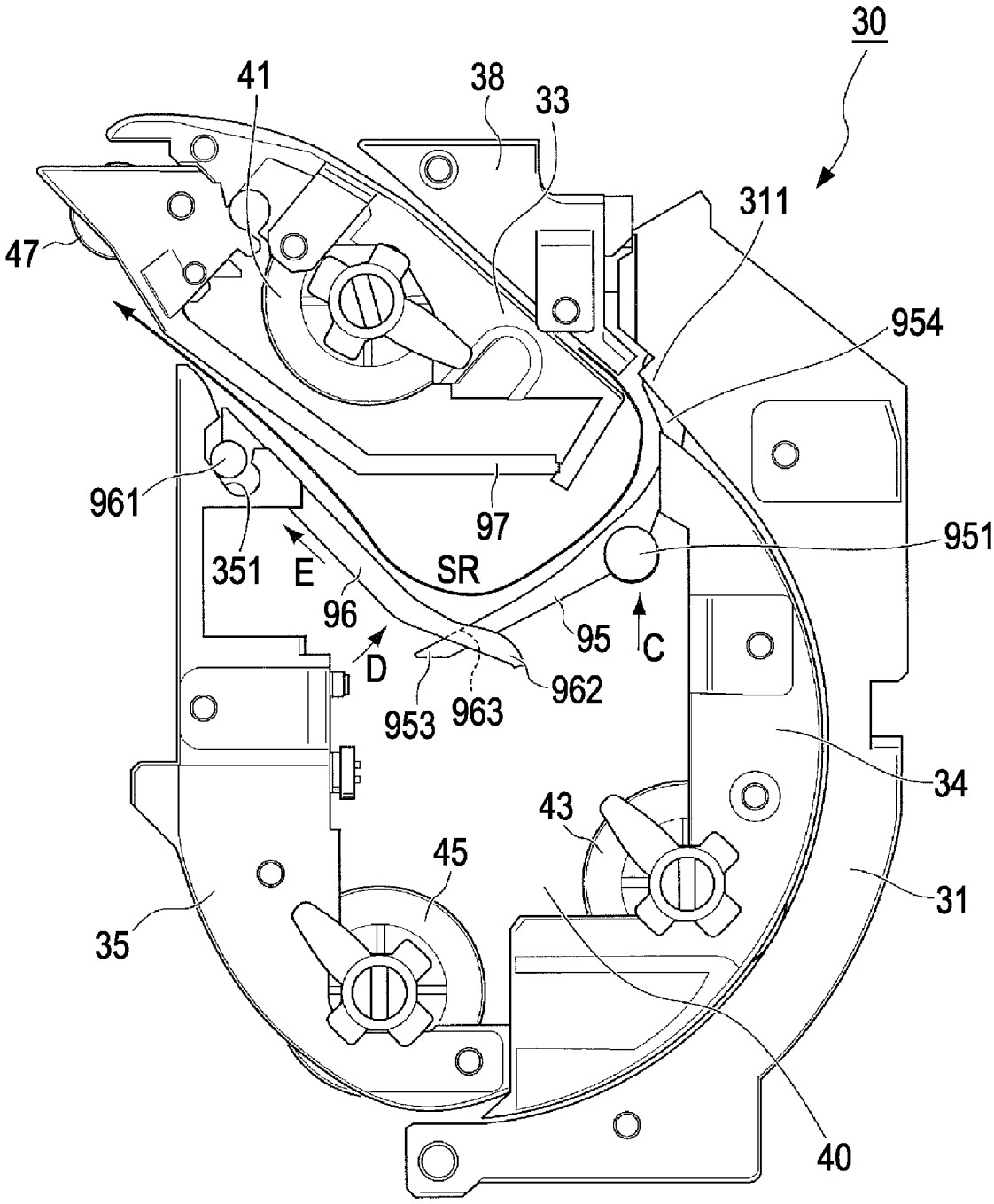
FIG. 11 is a cross-sectional side view illustrating principal portions in a state in which the path length of the second circulation path changes.

FIGS. 9 to 11 are cross-sectional side views of principal portions of the paper inverting apparatus 30 according to the first embodiment. FIG. 9 is an enlarged view illustrating the area in which the first guide member 95 and second guide member 96 are disposed, while FIGS. 10 and 11 illustrate states in which the path length of the second circulation path SR changes.

Adjusting the rotational position of the eccentric rotational member 94 by executing rotational control of the path switching and extending/contracting motor 91 based on output signals from the rotary encoder 92 makes it possible to control the displacement position of the first guide member 95. When the first guide member 95 displaces in the direction indicated by the reference symbol C, the guide portions 954 of the first guide member 95 advance into the first circulation path R. The guide portions 954 of the first guide member 95 enter a state in which the vicinity of the leading ends thereof have entered between the ribs 311 of the outer guide member 31. As a result, the recording paper P that has advanced into the path between the inner guide member 33 and the second flap 38 enters a state in which it is guided into the internal space 40 from a gap provided between the inner guide member 33 and the inner guide member 34. The recording paper P that has been guided into the internal space 40 is transported by the rotation of the first inverting driving roller 41 while sliding along the paper guide surface configured of the first guide member 95 and the second guide member 96. In other words, the front and back of the recording paper P are inverted by passing through the second circulation path SR. Meanwhile, the first guide member 95 also functions as a "path selection mechanism" for selecting either the first circulation path R or the second circulation path SR.

As the first guide member 95 is displaced further in the direction indicated by the reference symbol C, the engagement between the comb-tooth portion 953 of the first guide member 95 and the comb-tooth portion 962 of the second guide member 96 deepens, and as a result, the path length of the second circulation path SR shortens (FIG. 10). When the first guide member 95 is displaced even further in the direction indicated by the reference symbol C, the vicinity of the leading ends of the comb-tooth portion 953 of the first guide member 95 makes contact with the base member end portion 963 of the second guide member 96, and thus the first guide member 95 displaces the second guide member 96 by pushing the second guide member 96 upward. Through this, the second guide member 96 swings in the direction indicated by the reference symbol D and displaces by sliding in the direction indicated by the reference symbol E, and as a result, the path length of the second circulation path SR shortens further (FIG. 11).

It is preferable for the path length of the first circulation path R to be set to the same length as the length of the recording paper P (the length in the sub scanning direction Y of the recording paper P; the same applies hereinafter) of the maximum size onto which recording can be executed by the ink jet printer 50, or set to a length that is slightly longer than the stated length. For example, the maximum size of the recording paper P onto which recording can be executed by the ink jet printer 50 in this embodiment is A3+ (the size being slightly larger than the standard A3-size). Accordingly, the path length of the first circulation path R in this embodiment is set to approximately the same length as A3+ recording paper P, or in other words, the optimum length at which there is no excess/deficiency in inverting the front and back of A3+ recording paper P. Meanwhile, the path length of the second circulation path SR in this embodiment is, in its maximum extended state, approximately the same as the length of A4-size recording paper P, and is, in its maximum contracted state, approximately the same as the length of B5-size recording paper P. Accordingly, dual-sided recording on A4 or less-size recording paper P can be executed by inverting the front and back of the recording paper P by passing through the second circulation path SR and furthermore extending/contracting the path length of the second circulation path SR in accordance with the size of the recording paper P to the optimum length whereby no excess/deficiency arises.

As described thus far, the paper inverting apparatus 30 according to the invention has the first circulation path R and the second circulation path SR having different path lengths and the "path selection mechanism" for selecting the first circulation path R or the second circulation path SR; therefore, the circulation path having the optimum path length can be selected in accordance with the size of the recording paper P whose front and back are to be inverted. Accordingly, the paper inverting apparatus 30 according to the invention can reduce the risk of the front and back of the recording paper P being inverted by passing through a circulation path whose path length is longer than necessary, thus making it possible to invert the front and back of the recording paper P in a shorter amount of time. Accordingly, the throughput can be improved in the ink jet printer 50 that includes the paper inverting apparatus 30 according to the invention.

Furthermore, the paper inverting apparatus 30 according to the invention is capable of extending/contracting the path length of the second circulation path SR in accordance with the size of the recording paper P whose front and back are to be inverted. Accordingly, the paper inverting apparatus 30 according to the invention can reduce the risk of the front and back of the recording paper P being inverted by passing through a circulation path whose path length is longer than necessary, thus making it possible to invert the front and back of the recording paper P in a shorter amount of time. Accordingly, the throughput can be improved in the ink jet printer 50 that includes the paper inverting apparatus 30 according to the invention.

Although the paper inverting apparatus 30 of this embodiment includes both a structure in which multiple circulation paths whose path lengths differ (the first circulation path R and the second circulation path SR) and a structure enabling the extending/contracting of the path lengths of the circulation paths (the first guide member 95 and the second guide member 96), the invention can also be implemented, and the effects of the invention achieved, through a configuration in which only one of these structures is provided.

Second Embodiment of Paper Inverting Apparatus 30

A second embodiment of the paper inverting apparatus 30 will be described with reference to FIG. 12.

Figure 12:
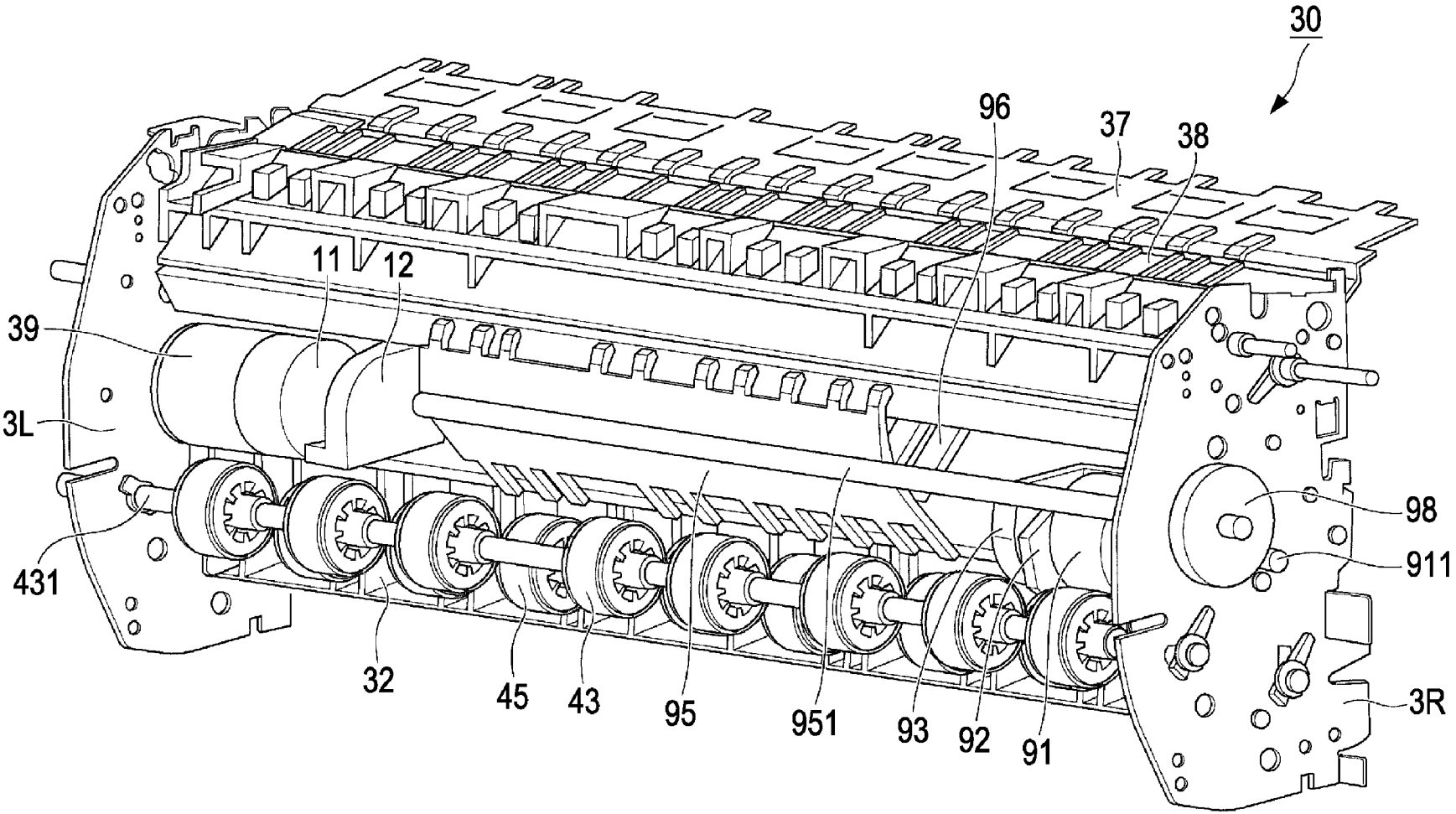
FIG. 12 is a perspective view illustrating principal portions of a paper inverting apparatus according to a second embodiment.

FIG. 12 is a perspective view illustrating principal portions of the paper inverting apparatus 30 according to the second embodiment.

The shaft portion 951 of the first guide member 95 is axially supported by the right side frame 3R, and a rotational member 98 is provided on the end of the shaft portion 951 in an integrated manner. The outer circumferential surface of the rotational member 98 is interlocked with the driving pulley 911 of the path switching and extending/contracting motor 91. In other words, the first guide member 95 is rotated by rotating the path switching and extending/contracting motor 91. The paper inverting apparatus 30 capable of extending/contracting the path length of the second circulation path SR can be realized in such a configuration as well.

Note that with the paper inverting apparatus 30 according to the second embodiment, configurations aside from those mentioned above are the same as those in the first embodiment, and thus descriptions thereof will be omitted.

Third Embodiment of Paper Inverting Apparatus 30

A third embodiment of the paper inverting apparatus 30 will be described with reference to FIG. 13.

Figure 13:
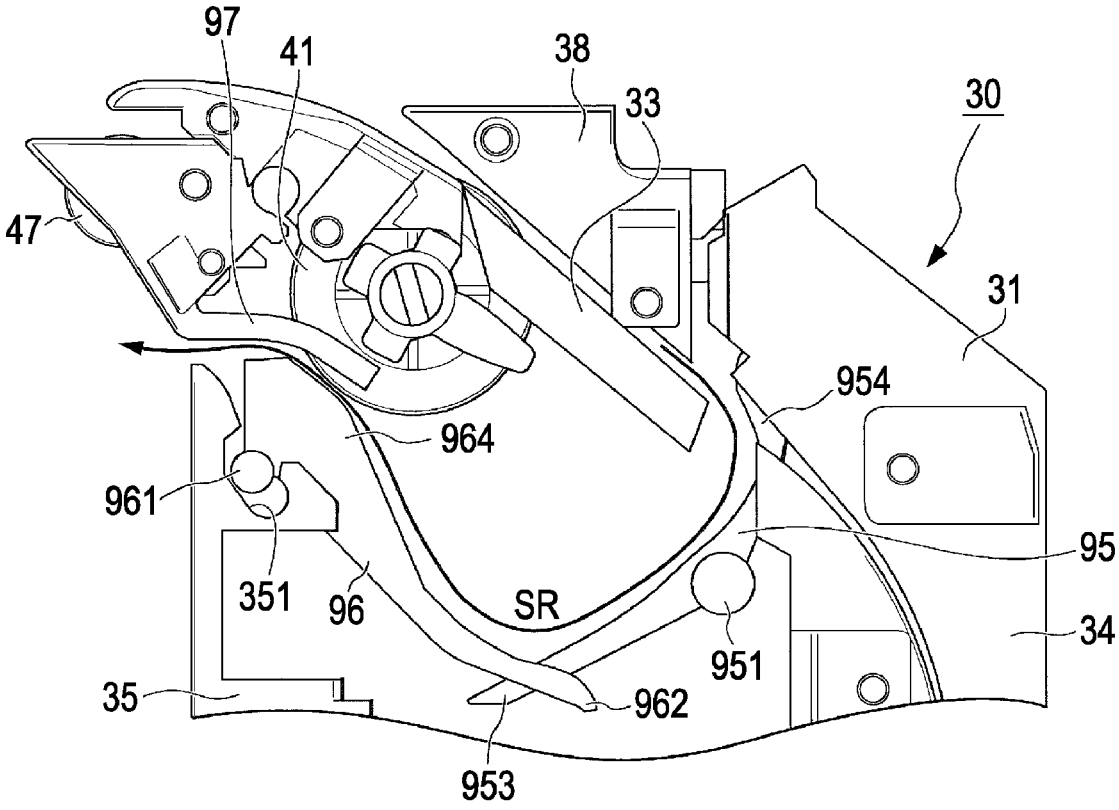
FIG. 13 is a cross-sectional side view of principal portions of a paper inverting apparatus according to a third embodiment.

FIG. 13 is a cross-sectional side view of principal portions of the paper inverting apparatus 30 according to the third embodiment, and illustrates an enlarged view of the vicinity of the second circulation path SR.

In the paper inverting apparatus 30 according to the third embodiment, a guide portion 964 is provided in the second guide member 96. The guide portion 964 is provided so as to cause the recording paper P in the second circulation path SR to make contact with the outer circumferential surface of the first inverting driving roller 41. In other words, the recording paper P in the second circulation path SR makes contact with the outer circumferential surface of the first inverting driving roller 41 in the space between the inner guide member 33 and the second flap 38, and makes contact with the outer circumferential surface of the first inverting driving roller 41 in the area where the recording paper P slides along the guide portion 964 of the second guide member 96. The paper inverting apparatus 30 according to the third embodiment configured in this manner is capable of transporting the recording paper P in the second circulation path SR with certainty, and thus is capable of reducing the risk of paper jams and so on occurring in the second circulation path SR.

Note that with the paper inverting apparatus 30 according to the third embodiment, configurations aside from those mentioned above are the same as those in the first embodiment, and thus descriptions thereof will be omitted.

First Embodiment of Control of Ink Jet Printer 50

A first embodiment of a control procedure for the ink jet printer 50 provided with the paper inverting apparatus 30 according to the invention will be described hereinafter with reference to FIGS. 14 and 15.

Figure 14:
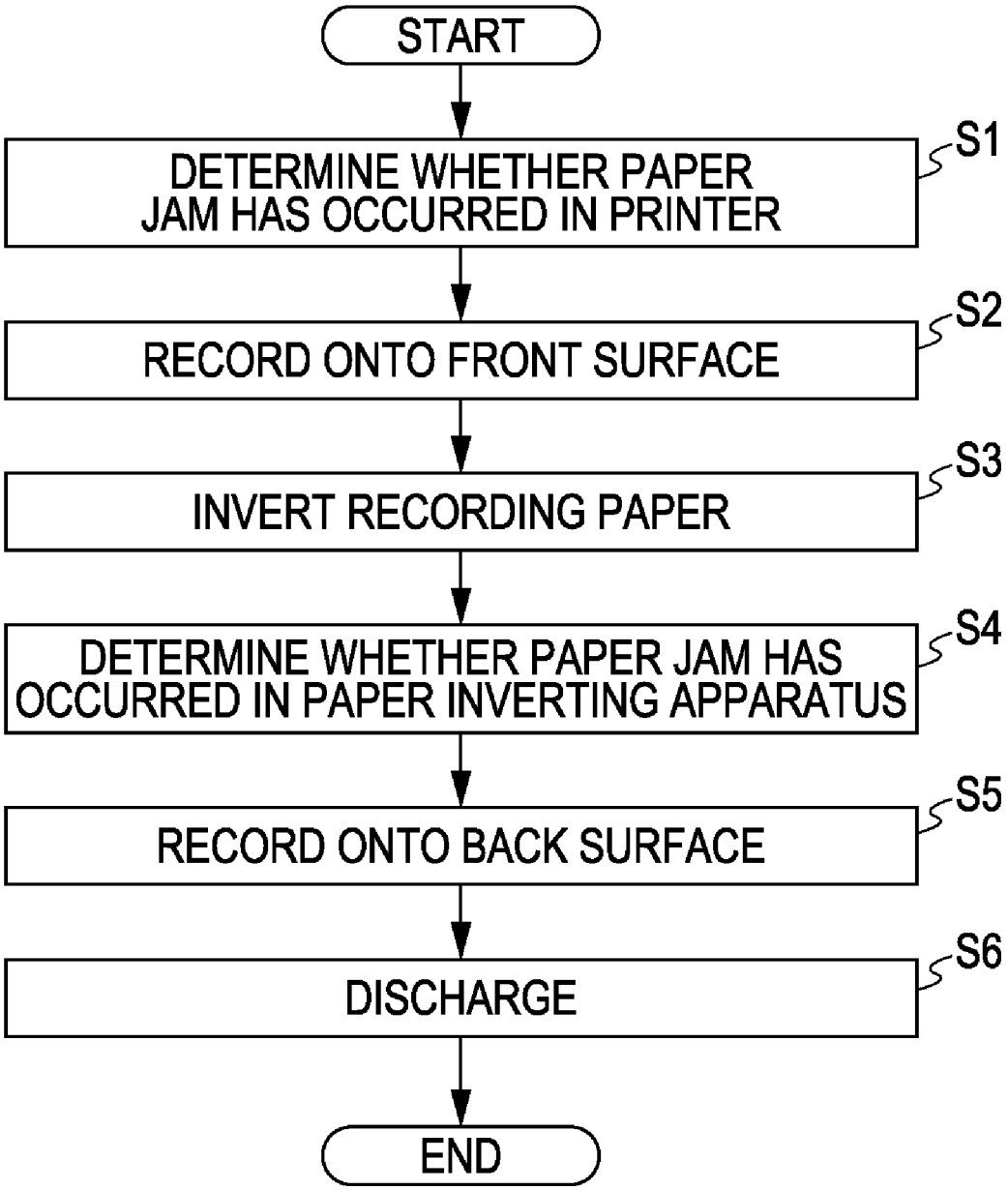
FIG. 14 is a flowchart illustrating a procedure by which recording onto both sides of recording paper is executed.

FIG. 14 is a flowchart illustrating a procedure by which recording onto both sides of the recording paper P is executed.

This procedure is a procedure that is realized by a control program executed by the aforementioned control unit provided in the main body of the ink jet printer 50. To be more specific, control for switching between the first circulation path R and the second circulation path SR, and control for extending/contracting the path length of the second circulation path SR, are executed by controlling the path switching and extending/contracting motor 91 in accordance with the length of the recording paper P in the direction in which the recording paper P is transported in the circulation paths. Details will be given hereinafter.

First, after the recording paper P has been supplied by the first automatic supply unit 70 or the second automatic supply unit 80, it is determined whether or not a paper jam has occurred in the ink jet printer 50, prior to commencing recording onto the front surface of the recording paper P (step S1 (hereinafter called as Sn, n=1, 2, 3 and so on)). To be more specific, after operations for supplying the recording paper P have been executed by the first automatic supply unit 70 or the second automatic supply unit 80, the presence/absence of recording paper P is detected by a known paper detector (not shown) or the like provided upstream to the transport driving roller 51 (that is, upstream in the sub scanning direction Y). In the case where the recording paper P cannot be detected, it is determined that a paper jam has occurred within the first automatic supply unit 70 or the second automatic supply unit 80, or in the first supply path F1 or the second supply path F2. In the case where it has been determined that a paper jam has occurred, the recording is canceled, and a predetermined error process, such as causing an error display light (not shown) provided in the ink jet printer 50 to light up, is executed.

In the case, however, where it has been determined that a paper jam has not occurred in the ink jet printer 50, recording onto the front surface of the supplied recording paper P is executed (S2). Next, the recording paper P, onto the front surface of which recording has been executed, is reversed and delivered to the paper inverting apparatus 30, where the front and back of the recording paper P, onto the front surface of which recording has been executed, are inverted (S3). Next, before commencing recording onto the back surface of the recording paper P, it is determined whether a paper jam has occurred in the paper inverting apparatus 30 (S4). To be more specific, for example, after the operations for inverting the front and back of the recording paper P have been executed by the paper inverting apparatus 30, the presence/absence of recording paper P is detected by the aforementioned paper detector or the like. In the case where the recording paper P cannot be detected, it is determined that a paper jam has occurred within the paper inverting apparatus 30. In the case where it has been determined that a paper jam has occurred, the recording may be canceled and a predetermined error processing may be executed. Meanwhile, in the case where it has been determined that a paper jam has not occurred within the paper inverting apparatus 30, recording onto the back surface of the recording paper P whose front and back have been inverted is executed (S5). Then, the recording paper P, onto the back surface of which the recording has been executed, is discharged (S6).

Figure 15:
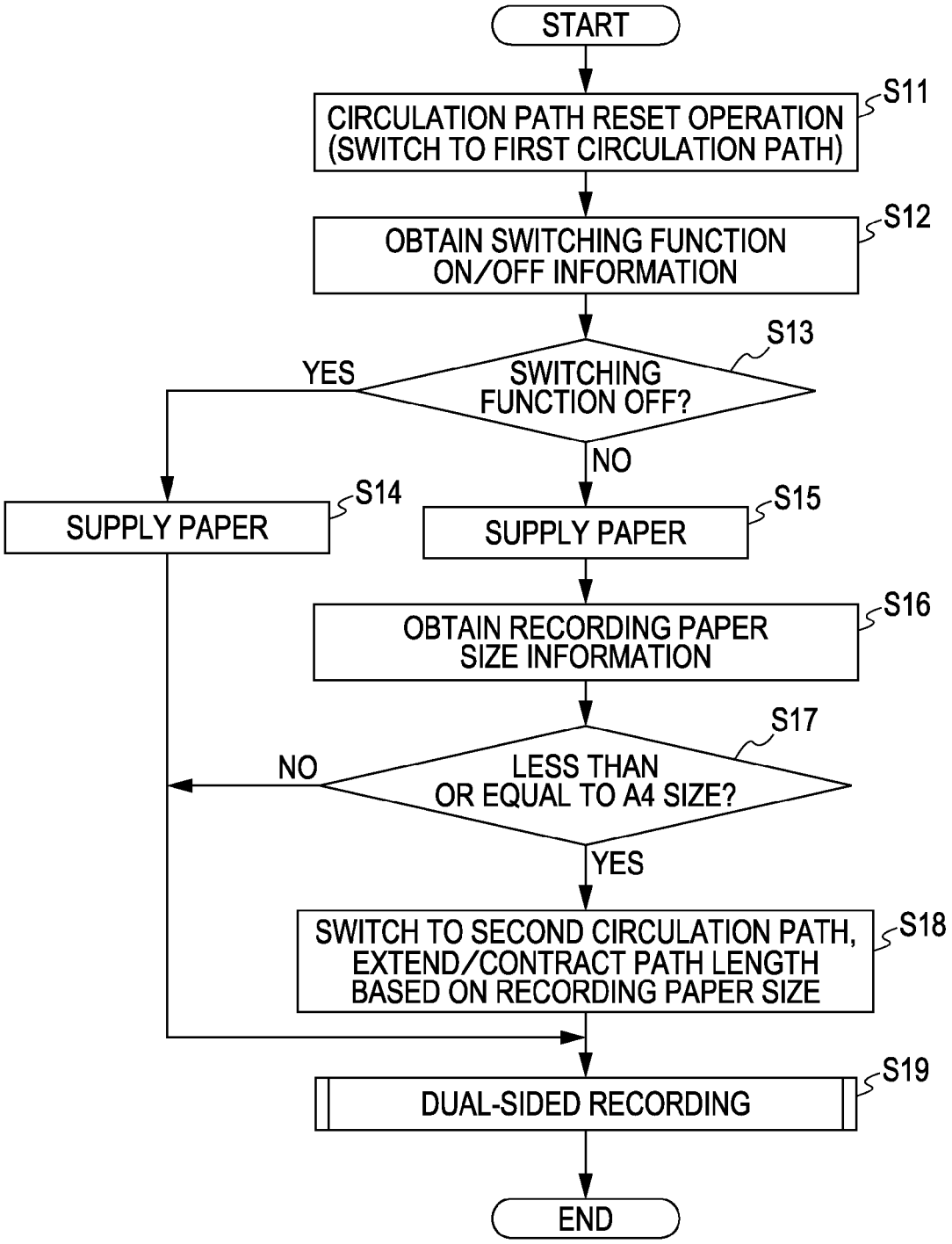
FIG. 15 is a flowchart illustrating a first embodiment of control of an ink jet printer.

FIG. 15 is a flowchart illustrating a first embodiment of control of the ink jet printer 50.

Before the recording paper P is delivered by the first automatic supply unit 70 or the second automatic supply unit 80, an operation for resetting the circulation paths is executed (S11). To be more specific, the first guide member 95 is displaced so that the guide portion 954 of the first guide member 95 enters a state in which it is retracted from the first circulation path R, or in other words, so that the apparatus enters a state in which the front and back of the recording paper P are inverted by passing through the first circulation path R.

Next, switching function ON/OFF information of the circulation paths is obtained (S12). This switching function ON/OFF information is information through which a user selects either the first circulation path R or the second circulation path SR in accordance with the size of the recording paper P and sets, as desired, whether or not to use a function for automatically switching between the two circulation paths. To be more specific, for example, an ON/OFF setting for that function as set by the user through an operation panel (not shown) or the like provided in the ink jet printer 50 may be stored in the control unit, and the setting information stored in the control unit may then be obtained. Alternatively, the user may set the function to be ON/OFF through a settings screen of a printer driver running on a personal computer (not shown) connected to the ink jet printer 50, and the setting information of the printer driver set by the user may then be obtained.

Next, it is determined whether or not the circulation path switching function is set to OFF (S13). In the case where the circulation path switching function is set to OFF (Yes in S13), the operation for supplying the recording paper P is executed directly (S14), and the dual-side recording procedure illustrated in the flowchart of FIG. 14 (called simply "dual-sided recording" hereinafter) is executed (S19). In this case, the inversion of the front and back of the recording paper P is always carried out by passing through the first circulation path R, regardless of the size of the recording paper P.

However, in the case where the circulation path switching function is set to ON (No in S13), after the operation for supplying the recording paper P has been executed (S15), size information of that recording paper P is obtained (S16). The size information of the recording paper P can be obtained, for example, by making the size of the recording paper P as set by the user through the operation panel or the like (not shown) provided in the ink jet printer 50 be stored in a storage medium (a RAM or the like) of the control unit, and then reading out the setting information stored in that storage medium. Alternatively, the user may set the size of the recording paper P using a settings screen of a printer driver running on a personal computer (not shown) connected to the ink jet printer 50, and the setting information of the printer driver as set by that user may then be obtained from the personal computer.

Next, it is determined whether or not the obtained size information of the recording paper P is less than or equal to the A4 size (S17). The A4 size is the maximum size for which the front and back of the recording paper P can be inverted by passing through the second circulation path SR. In the case where the obtained size information of the recording paper P is greater than the A4 size (No in S17), such as the case where, for example, the obtained size information of the recording paper P is A3+, B4, or the like, dual-sided recording is executed directly (S19). In other words, for recording paper P that is A3+ or B4 sized, the inversion of the front and back of the recording paper P is carried out by passing through the first circulation path R.

On the other hand, in the case where the obtained size information of the recording paper P is less than or equal to the A4 size (Yes in S17), the circulation path is switched to the second circulation path SR (S18). To be more specific, the first guide member 95 is displaced so that the guide portion 954 of the first guide member 95 enters a state in which it is advanced into the first circulation path R, or in other words, so that the apparatus enters a state in which the front and back of the recording paper P are inverted by passing through the second circulation path SR. Furthermore, the path length of the second circulation path SR is caused to extend/contract in accordance with the obtained size information of the recording paper P by displacing the first guide member 95 (S18). Then, dual-sided recording onto the recording paper P is executed (S19). In other words, for recording paper P that is less than or equal to the A4 size, such as the A4 size, the B5 size, or the like, the inversion of the front and back of the recording paper P is carried out by passing through the second circulation path SR. Furthermore, the path length of the second circulation path SR is adjusted so as to extend/contract to the optimum length in accordance with the size of the recording paper P.

In this manner, control for automatically switching between the first circulation path R and the second circulation path SR, and control for automatically extending/contracting the path length of the second circulation path SR, are executed in accordance with the size of the recording paper P whose front and back are to be inverted so as to achieve the optimum path length. Accordingly, the throughput of the ink jet printer 50 can be improved, and the usability of the paper inverting apparatus 30 can be improved as well. Furthermore, the risk of using more time than is necessary in the inversion of the front and back of the recording paper P due to the path length of the circulation path being too long, and conversely, the risk of paper jams and the like occurring due to the path length of the circulation path being too short, can be reduced.

Second Embodiment of Control of Ink Jet Printer 50

A second embodiment of a control procedure for the ink jet printer 50 provided with the paper inverting apparatus 30 according to the invention will be described hereinafter with reference to FIG. 16.

Figure 16:
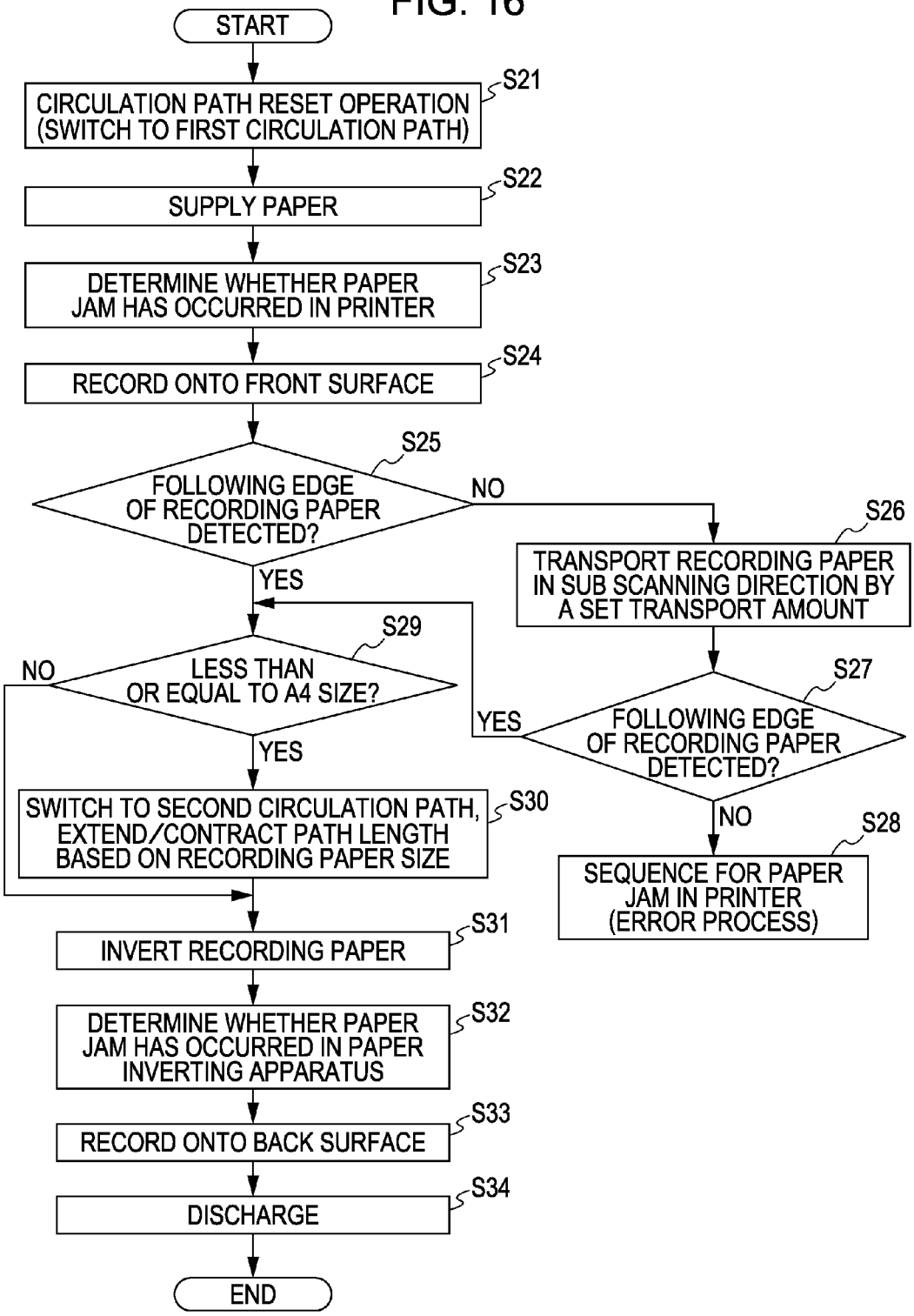
FIG. 16 is a flowchart illustrating a second embodiment of control of an ink jet printer.

FIG. 16 is a flowchart illustrating a second embodiment of control of the ink jet printer 50. As with the first embodiment of the control, this procedure is a procedure that is realized by a control program executed by the aforementioned control unit provided in the main body of the ink jet printer 50, and is a procedure for executing control for switching between the first circulation path R and the second circulation path SR and control for extending/contracting the path length of the second circulation path SR.

Before the recording paper P is delivered by the first automatic supply unit 70 or the second automatic supply unit 80, an operation for resetting the circulation paths is executed (S21). Next, after operations for supplying the recording paper P have been executed (S22), it is determined whether or not a paper jam has occurred in the ink jet printer 50 (S23). Next, recording onto the front surface of the recording paper P is executed (S24), and it is then determined whether or not a sensor or the like (not shown) provided in the carriage 61 has detected the following edge of the recording paper P in the sub scanning direction Y during the execution of recording (S25). The sensor is, for example, an optical sensor that is capable of detecting the recording paper P without making contact therewith.

In the case where the following edge of the recording paper P in the sub scanning direction Y has been detected during the execution of recording (Yes in S25), the size of the recording paper P is detected based on the detection position of that following edge, and it is then determined whether or not the size of the recording paper P is less than or equal to the A4 size (S29). To be more specific, the leading edge of the recording paper P in the sub scanning direction Y is detected by the sensor provided in the carriage 61 during cueing operations or the like prior to commencing the recording onto the front surface. Then, the length of the recording paper P in the sub scanning direction Y is identified based on the total transport amount of the recording paper P in the sub scanning direction Y from the position at which the leading edge was detected to when the following edge has been detected during the execution of recording. The size of the recording paper P is identified based on that length, and it is then determined whether or not the recording paper P is less than or equal to the A4 size.

In the case where the identified size of the recording paper P is greater than the A4 size (No in S29), such as the case where, for example, the identified size of the recording paper P is A3+ or B4, the front and back of the recording paper P are inverted by passing through the first circulation path R directly (S31). Next, it is determined whether a paper jam has occurred in the paper inverting apparatus 30 (S32), recording is executed onto the back surface of the recording paper P (S33), and the recording paper P is discharged (S34).

However, in the case where the identified size of the recording paper P is less than or equal to the A4 size (Yes in S29), the circulation path is switched to the second circulation path SR, and the path length of the second circulation path SR is extended/contracted in accordance with the identified size of the recording paper P (S30). After the front and back of the recording paper P have been inverted by passing through the second circulation path SR (S31), it is determined whether or not a paper jam has occurred within the paper inverting apparatus 30 (S32), and recording onto the back surface of the recording paper P is executed (S33) and the recording paper P is discharged (S34).

On the other hand, in the case where the following edge of the recording paper P in the sub scanning direction Y could not be detected during execution of recording (No in S25), the recording paper P is once again transported in the sub scanning direction Y by a set transport amount (S26), and it is determined whether or not the following edge of the recording paper P has been detected (S27). A procedure for once again transporting the recording paper P after the execution of recording onto the front surface thereof is provided because in the case where, for example, a margin greater than a set width is present toward the following edge of the recording paper P in the sub scanning direction Y, the following edge of the recording paper P has not reached a position at which it can be detected by the sensor provided in the carriage 61 at the point in time at which the recording onto the front surface of the recording paper P has been completed.

In the case where the following edge of the recording paper P cannot be detected even during the re-transporting (No in S27), it is determined that a paper jam or the like has occurred in the ink jet printer 50, and a predetermined paper jam sequence is executed (S28). For example, an error process, such as causing an error display light (not shown) provided in the ink jet printer 50 to light up, is executed. However, in the case where the following edge of the recording paper P has been detected during the re-transport, the procedure advances to S29. The steps from S29 to S34 are the same as those described above.

In this manner, when executing recording onto the front surface of the recording paper P, the length of the recording paper P in the sub scanning direction Y may be actually measured by detecting the leading edge position and following edge position of the recording paper P in the sub scanning direction Y, and the circulation path may be selected and extended/contracted based thereon. Accordingly, it is possible to reduce the risk of paper jams and the like occurring even in the case where, for example, a user has mistakenly set the size of the recording paper P or the like.

Third Embodiment of Control of Ink Jet Printer 50

A third embodiment of a control procedure for the ink jet printer 50 provided with the paper inverting apparatus 30 according to the invention will be described hereinafter with reference to FIGS. 17A and 17B.

Figure 17A:
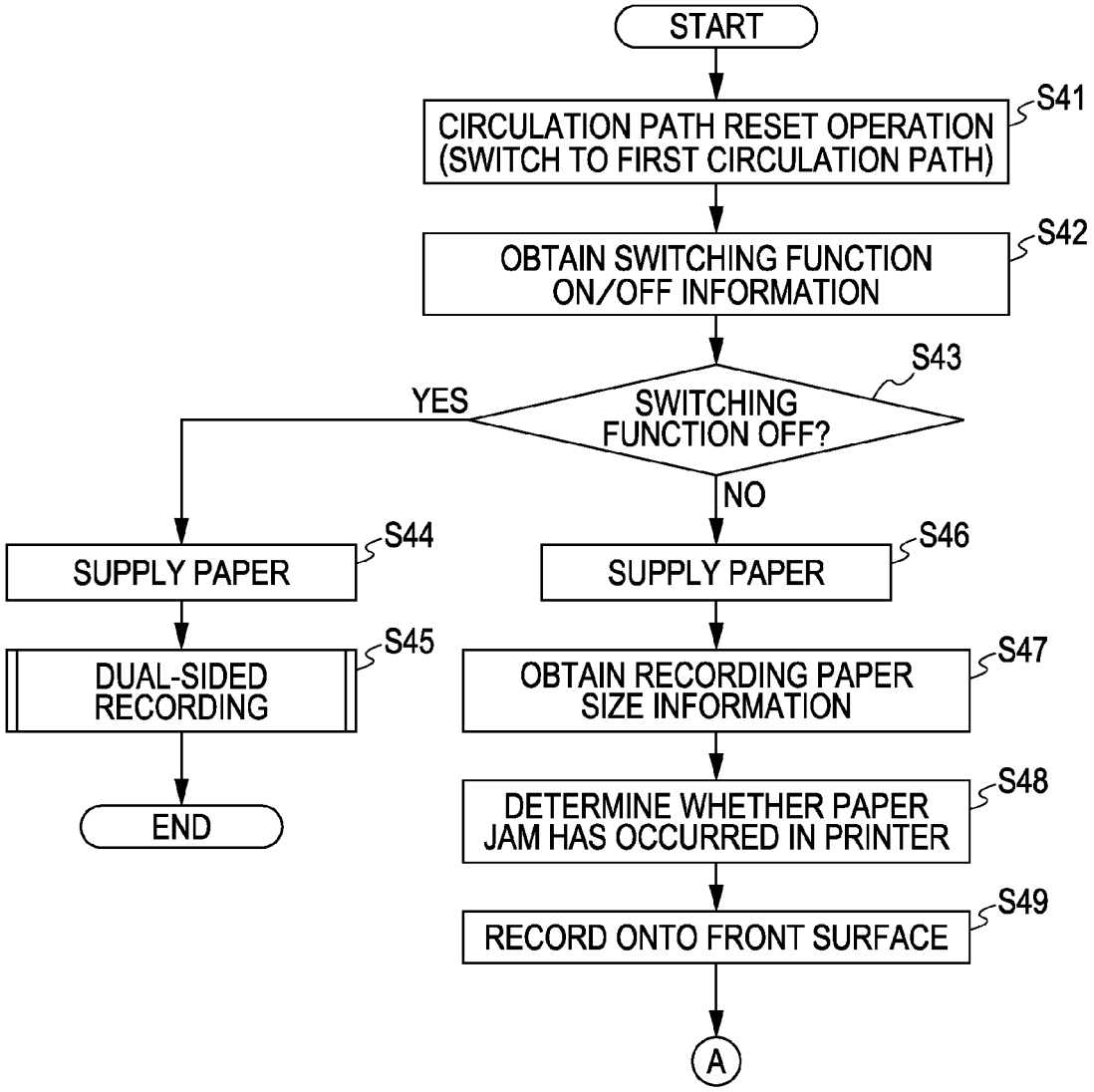
FIG. 17A is a flowchart illustrating a third embodiment of control of an ink jet printer.
Figure 17B:
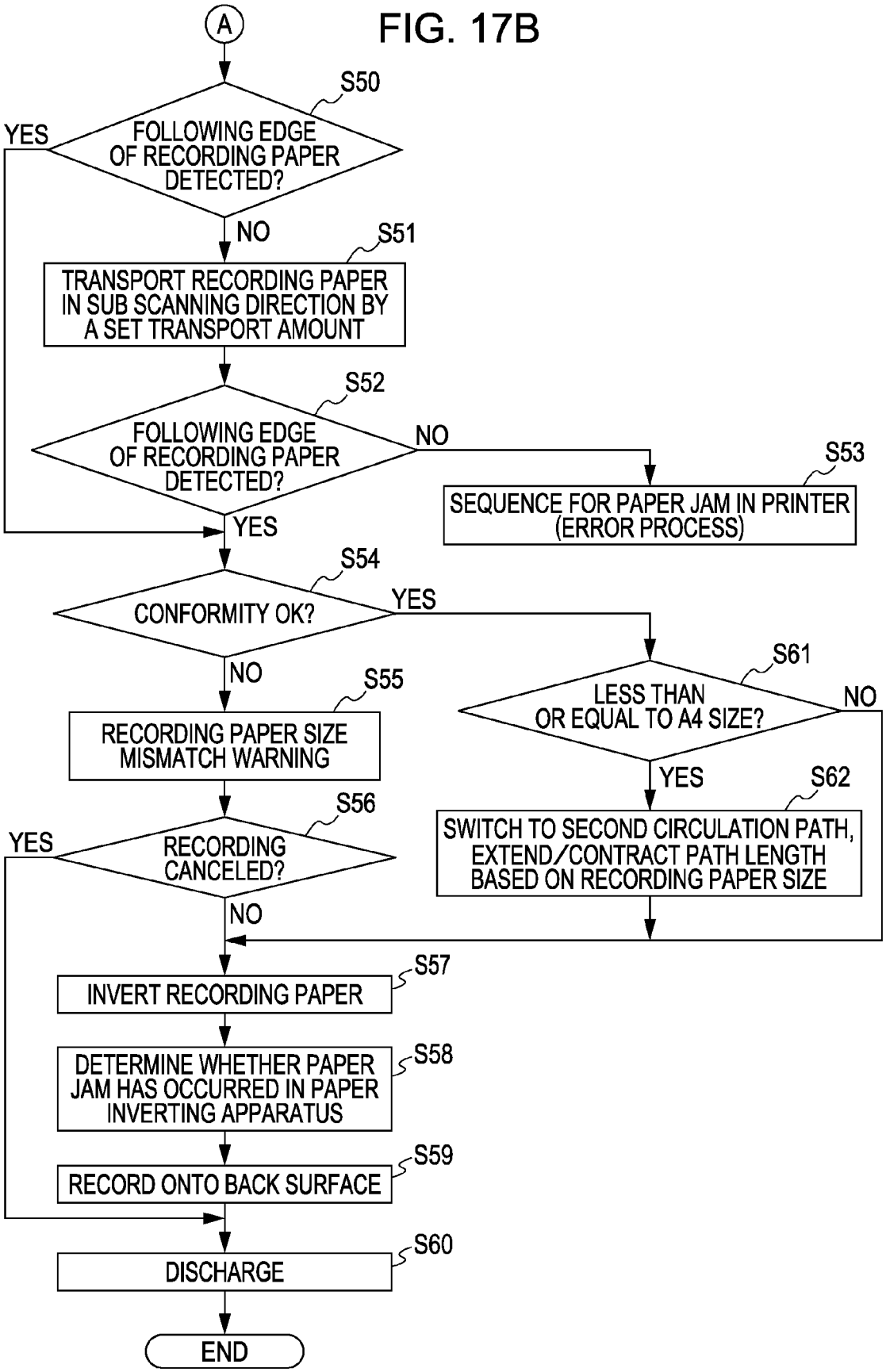
FIG. 17B is a flowchart illustrating a third embodiment of control of an ink jet printer.

FIGS. 17A and 17B are a flowchart illustrating a third embodiment of control of the ink jet printer 50. As with the first embodiment of the control, this procedure is a procedure that is realized by a control program executed by the aforementioned control unit provided in the main body of the ink jet printer 50, and is a procedure for executing control for switching between the first circulation path R and the second circulation path SR and control for extending/contracting the path length of the second circulation path SR.

The steps from S41 to S45 are the same as the steps from S11 to S14 and S19 illustrated in the flowchart of FIG. 15, and thus descriptions thereof will be omitted. Furthermore, the steps of S46 and S47 are the same as the steps of S15 and S16 illustrated in the flowchart of FIG. 15, and thus descriptions thereof will be omitted as well.

In this embodiment, after size information of the recording paper P has been obtained (S47), it is determined whether or not a paper jam has occurred in the ink jet printer 50 (S48) without carrying out determination for selecting a circulation path at that point in time. Then, in the case where it has been determined that a paper jam has not occurred, recording onto the front surface of the recording paper P is executed (S49), and it is determined whether or not the following edge of the recording paper P in the sub scanning direction Y has been detected by a sensor provided in the carriage 61 during execution of the recording (S50).

In the case where the following edge of the recording paper P in the sub scanning direction Y could not be detected during the execution of recording (No in S50), the procedure advances to S51. The steps from S51 to S53 are the same as the steps from S26 to S28 illustrated in the flowchart of FIG. 16, and thus descriptions thereof will be omitted.

In the case where the following edge of the recording paper P in the sub scanning direction Y has been detected during the execution of recording (Yes in S50), or in the case where the following edge of the recording paper P has been detected during a re-transport (Yes in S52), the size of the recording paper P is identified based on the detection position of the following edge, and it is determined whether or not the identified size of the recording paper P conforms with (matches with) the size information of the recording paper P obtained in S47 (S54).

In the case where the size of the recording paper P identified based on the detection position of the following edge thereof and the size information of the recording paper P do not conform to each other (No in S54), the user is warned that the size of the recording paper P that he/she set does not match with the size of the recording paper P onto the front surface of which recording has actually been executed (S55). To be more specific, for example, a warning display light (not shown) provided in the ink jet printer 50 may be caused to light up, or the like.

Next, it is determined whether or not the user has carried out operations for canceling the recording onto the recording paper P (S56). In the case where the user has carried out operations for canceling the recording onto the recording paper P (Yes in S56), the recording paper is discharged as-is, without executing recording onto the back surface thereof (S60). On the other hand, in the case where the user has carried out operations for continuing the recording onto the recording paper P (No in S56), the front and back of the recording paper P are inverted by passing through the first circulation path R directly (S57). Next, it is determined whether a paper jam has occurred in the paper inverting apparatus 30 (S58), recording is executed onto the back surface of the recording paper P (S59), and the recording paper P is discharged (S60).

Meanwhile, in the case where the size of the recording paper P identified based on the detection position of the following edge and the size information of the recording paper P match (Yes in S54), it is determined whether or not the size of the recording paper P is less than or equal to the A4 size (S61). In the case where the identified size of the recording paper P exceeds the A4 size (No in S61), the front and back of the recording paper P are inverted by passing through the first circulation path R directly (S57). Then, it is determined whether or not a paper jam has occurred in the paper inverting apparatus 30, recording is executed onto the back surface of the recording paper P, and the recording paper P is discharged (S58 to S60). However, in the case where the identified size of the recording paper P is less than or equal to the A4 size (Yes in S61), the circulation path is switched to the second circulation path SR, and the path length of the second circulation path SR is extended/contracted in accordance with the identified size of the recording paper P (S62). Next, the front and back of the recording paper P are inverted by passing through the second circulation path SR (S57). Then, it is determined whether or not a paper jam has occurred in the paper inverting apparatus 30, recording is executed onto the back surface of the recording paper P, and the recording paper P is discharged (S58 to S60).

In this manner, when executing recording onto the front surface of the recording paper P, the length of the recording paper P in the sub scanning direction Y may be identified by detecting the leading edge position and the following edge position of the recording paper P, and it may then be determined whether or not that identified length conforms to the size information of the recording paper P as set by the user. The selection and extending/contracting of the circulation path is then executed in accordance with the length of the recording paper P only in the case where that length conforms to the size information of the recording paper P as set by the user. Accordingly, it is possible to reduce the risk of paper jams and the like occurring in the case where, for example, the user has mistakenly set the size of the recording paper P or the like. Furthermore, the risk of wastefully consuming recording paper P due to executing recording onto recording paper P of a size that differs from the size which the user intends to use can be reduced as well.

Other Embodiments

The invention is not intended to be limited to the aforementioned embodiments, and many variations are possible within the scope of the invention as disclosed in the appended claims; it goes without saying that such variations also fall within the scope of the invention. For example, although the aforementioned embodiments use an ink jet printer 50 as an example of an electronic device provided with the paper inverting apparatus, the invention can also be applied to a scanner, facsimile, copy machine, printer/multifunction peripheral, or the like provided with the paper inverting apparatus. To be more specific, for example, in the ink jet printer 50 described in the aforementioned embodiments, a known image reading unit, such as an image sensor capable of reading text or images recorded on a document or the like, may be provided in place of the carriage 61 and the recording head 62.

What is claimed is:

1. A paper inverting apparatus that inverts the front and back of paper by transporting the paper through a paper inverting path that inverts the front and back of the paper, the apparatus comprising:

an extending and contracting mechanism that extends and contracts the path length of a circulation path of which the paper inverting path is configured, wherein the extending and contracting mechanism includes a first guide member and a second guide member that form the circulation path, the first guide member and the second guide member being supported so as to be capable of displacement such that the first guide member and the second guide member form a continuous paper guide surface by part of the first guide member and part of the second guide member engaging with each other in an intersecting state at a point of engagement, wherein the part of the first guide member and the part of the second guide member that engage with each other at the point of engagement are part of the continuous paper guide surface such that the paper is able to be transported across the point of engagement, the first guide member, and the second guide member at the same time.

2. The paper inverting apparatus according to claim 1, herein the extending and contracting mechanism causes the circulation path to extend and contract by changing the position at which the first guide member and the second guide member intersect, by displacing at least one of the first guide member and the second guide member.

3. The paper inverting apparatus according to claim 2, wherein the first guide member and the second guide member configure a continuous paper guide surface by engaging with each other in a state in which a comb-tooth-shaped engagement portion provided in the first guide member and a comb-tooth-shaped engagement portion provided in the second guide member intersect with each other.

4. The paper inverting apparatus according to claim 1, further comprising:

a driving unit of the extending and contracting mechanism; and a control unit that controls the driving unit, wherein the control unit controls the driving unit based on the length of the paper in the direction in which the paper is transported in the circulation path.

5. An electronic device comprising:

a unit that executes recording onto a recording surface of paper or a unit that reads text or images recorded on recording paper; and a paper inverting apparatus that inverts the front and back of the paper by transporting the paper through a paper inverting path that inverts the front and back of the paper, the paper inverting apparatus including:

an extending and contracting mechanism that extends and contracts the path length of a circulation path of which the paper inverting path is configured, wherein the extending and contracting mechanism includes a first guide member and a second guide member that form the circulation path, the first guide member and the second guide member being supported so as to be capable of displacement such that the first guide member and the second guide member form a continuous paper guide surface by part of the first guide member and part of the second guide member engaging with each other in an intersecting state at a point of engagement, wherein the part of the first guide member and the part of the second guide member that engage with each other at the point of engagement are part of the continuous paper guide surface such that the paper is able to be transported across the point of engagement, the first guide member, and the second guide member at the same time.

6. The electronic device according to claim 5, wherein the extending and contracting mechanism causes the circulation path to extend and contract by changing the position at which the first guide member and the second guide member intersect, by displacing at least one of the first guide member and the second guide member.

7. The electronic device according to claim 6, wherein the first guide member and the second guide member configure a continuous paper guide surface by engaging with each other in a state in which a comb-tooth-shaped engagement portion provided in the first guide member and a comb-tooth-shaped engagement portion provided in the second guide member intersect with each other.

8. The electronic device according to claim 5, wherein the paper inverting apparatus further comprises:

a driving unit of the extending and contracting mechanism; and a control unit that controls the driving unit, wherein the control unit controls the driving unit based on the length of the paper in the direction in which the paper is transported in the circulation path.

* * * * *